US008882942B2

(12) United States Patent
Furuya et al.

(10) Patent No.: US 8,882,942 B2
(45) Date of Patent: Nov. 11, 2014

(54) NI-ADDED STEEL PLATE AND METHOD OF MANUFACTURING THE SAME

(75) Inventors: Hitoshi Furuya, Tokyo (JP); Naoki Saitoh, Tokyo (JP); Motohiro Okushima, Tokyo (JP); Yasunori Takahashi, Tokyo (JP); Takehiro Inoue, Tokyo (JP); Ryuji Uemori, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/806,457

(22) PCT Filed: Jul. 7, 2011

(86) PCT No.: PCT/JP2011/065599

§ 371 (c)(1),
(2), (4) Date: Dec. 21, 2012

(87) PCT Pub. No.: WO2012/005330

PCT Pub. Date: Jan. 12, 2012

(65) Prior Publication Data

US 2013/0098514 A1 Apr. 25, 2013

(30) Foreign Application Priority Data

Jul. 9, 2010 (JP) ..... 2010-156720

(51) Int. Cl.
*C22C 38/02* (2006.01)
*C22C 38/04* (2006.01)

(Continued)

(52) U.S. Cl.
CPC ..... *C22C 38/44* (2013.01); *C22C 38/04* (2013.01); *C22C 38/16* (2013.01); *C22C 38/14* (2013.01); *C21D 8/0226* (2013.01); *C22C 38/06* (2013.01); *C21D 2211/001* (2013.01); *C21D 9/14* (2013.01); *C22C 38/002* (2013.01); *C22C 38/40* (2013.01); *C21D 9/08* (2013.01); *C21D 6/001* (2013.01); *C22C 38/001* (2013.01); *C21D 6/04* (2013.01); *C22C 38/02* (2013.01); *C22C 38/12* (2013.01)
USPC ..... 148/621; 148/645; 148/335

(58) Field of Classification Search
CPC ..... C21D 2211/001; C21D 6/001; C21D 6/04
USPC ..... 148/621, 645, 335
See application file for complete search history.

(56) References Cited

U.S. PATENT DOCUMENTS 4,946,516 A 8/1990 Yano et al.

FOREIGN PATENT DOCUMENTS

EP 1942203 A1 * 7/2008
JP 56-156715 A 12/1981

(Continued)

OTHER PUBLICATIONS

Korean Notice of Allowance, dated Jun. 25, 2013, for Korean Application No. 10-2013-7000242 with a partial English translation.

(Continued)

*Primary Examiner* — Jie Yang
(74) *Attorney, Agent, or Firm* — Birch, Stewart, Kolasch & Birch, LLP

(57) ABSTRACT

A Ni-added steel plate contains, by mass %, C: 0.03% to 0.10%, Si: 0.02% to 0.40%, Mn: 0.3% to 1.2%, Ni: 5.0% to 7.5%, Cr: 0.4% to 1.5%, Mo: 0.02% to 0.4%, Al: 0.01% to 0.08%, T.O: 0.0001% to 0.0050%, P: limited to 0.0100% or less, S: limited to 0.0035% or less, and N: limited to 0.0070% or less with a remainder composed of Fe and inevitable impurities, in which a Ni segregation ratio at a position of ¼ of a plate thickness away from a plate surface in a thickness direction is 1.3 or less, a fraction of austenite after deep cooling is 2% or more, an austenite unevenness index after deep cooling is 5.0 or less, and an average equivalent circle diameter of austenite after deep cooling is 1 μm or less.

14 Claims, 5 Drawing Sheets

(51) Int. Cl.

| | |
|---|---|
| ***C22C 38/16*** | (2006.01) |
| ***C22C 38/14*** | (2006.01) |
| ***C22C 38/44*** | (2006.01) |
| ***C21D 8/02*** | (2006.01) |
| ***C22C 38/06*** | (2006.01) |
| ***C21D 9/14*** | (2006.01) |
| ***C22C 38/00*** | (2006.01) |
| ***C22C 38/40*** | (2006.01) |
| ***C21D 6/00*** | (2006.01) |
| ***C21D 6/04*** | (2006.01) |
| ***C22C 38/12*** | (2006.01) |
| *C21D 9/08* | (2006.01) |

(56) References Cited

FOREIGN PATENT DOCUMENTS

| | | | |
|---|---|---|---|
| JP | 61-133312 | A | 6/1986 |
| JP | 63-130245 | A | 6/1988 |
| JP | 4-14179 | B2 | 3/1992 |
| JP | 4-107219 | A | 4/1992 |
| JP | 4-371520 | A | 12/1992 |
| JP | 6-179909 | A | 6/1994 |
| JP | 7-278734 | A | 10/1995 |
| JP | 7-316654 | A | 12/1995 |
| JP | 9-20922 | A | 1/1997 |
| JP | 9-41036 | A | 2/1997 |
| JP | 9-41088 | A | 2/1997 |
| JP | 9-143557 | A | 6/1997 |
| JP | 2000-129351 | A | 5/2000 |
| JP | 2002-129280 | A | 5/2002 |
| JP | 2006-57136 | A | 3/2006 |
| JP | 2006-212671 | A | 8/2006 |
| KR | 10-2004-0054198 | A | 6/2004 |
| WO | WO 99/32672 | A1 | 7/1999 |
| WO | WO 2007/080646 | A1 | 7/2007 |
| WO | WO 2007/116913 | A1 | 10/2007 |
| WO | WO 2007/116919 | A1 | 10/2007 |

OTHER PUBLICATIONS

International Search Report issued in PCT/JP2011/065599, mailed on Sep. 27, 2011.

Yang et al., "Effect of Heat Treatment in the Ferrite-Austenite Region on Notch Toughness of 6% Nickel Steel," The Iron and Steel Institute of Japan, vol. 6, 1973, pp. 752-763.

European Search Report issued in Application No. 11803664.9 dated Feb. 11, 2014.

* cited by examiner

NI-ADDED STEEL PLATE AND METHOD OF MANUFACTURING THE SAME

TECHNICAL FIELD

The present invention relates to a Ni-added steel plate which is excellent in fracture-resisting performance (toughness, arrestability, and unstable fracture-suppressing characteristic described below) of a base metal and a welded joint of a steel plate and a method of manufacturing the same.

BACKGROUND ART

Steel used for a liquefied natural gas (LNG) tank needs to have fracture-resisting performance at an extremely low temperature of approximately −160° C. For example, 9% Ni steel is used for the inside tank of the LNG tank. The 9% Ni steel is a steel material that contains, by mass %, approximately 8.5% to 9.5% of Ni, has a microstructure mainly including tempered martensite, and is excellent in, particularly, low-temperature toughness (for example, Charpy impact-absorbing energy at −196° C.). Various techniques to improve the toughness of the 9% Ni steel have been disclosed. For example, Patent Documents 1 to 3 disclose techniques in which P that causes a decrease in toughness due to intergranular embrittlement is reduced. In addition, Patent Documents 4 to 6 disclose techniques in which tempering embrittlement sensitivity is reduced using a two-phase region thermal treatment so as to improve the toughness. Additionally, Patent Documents 7 to 9 disclose techniques in which Mo that can increase strength without increasing the tempering embrittlement sensitivity is added so as to significantly improve the toughness. Furthermore, Patent Documents 4, 8, and 10 disclose techniques in which the amount of Si that increases the tempering embrittlement sensitivity is reduced so as to improve the toughness. Meanwhile, a steel plate having a plate thickness of 4.5 mm to 80 mm is used as the 9% Ni steel for the LNG tanks. Among them, a steel plate having a plate thickness of 6 mm to 50 mm is mainly used.

Due to a current increase in the price of Ni, there is a demand for a steel material in which the addition of Ni is reduced in order to reduce the manufacturing costs of the LNG tanks. As a method in which the addition of Ni in the steel material is reduced to 6% so as to secure excellent base metal toughness, NonPatent Document 1 discloses a method in which a thermal treatment in an $\alpha$-$\gamma$ two-phase region (two-phase region thermal treatment) is used. The method is extremely effective in improving the fracture-resisting performance of base metal. That is, in spite of an amount of Ni being approximately 6%, a steel material obtained using the method has the same fracture-resisting performance (toughness described below) as the 9% Ni steel in terms of the base metal. However, in accordance with reduction of the amount of Ni, the fracture-resisting performance (toughness, arrestability, and unstable fracture-suppressing characteristic described below) of a welded joint significantly degrade. Therefore, it is difficult to use the steel material manufactured using the above method for the LNG tanks.

Hitherto, several methods to improve the fracture-resisting performance (toughness described below) of the welded joint have been proposed. For example, Patent Documents 11 to 14 disclose methods in which a preliminary thermal treatment for reducing segregation is carried out before a cast slab is heated and rolled. In addition, Patent Document 15 discloses a method in which two processes of rolling are carried out so as to decrease defects in a plate thickness central portion. However, in the method of Patent Documents 11 to 14, since the effect of segregation reduction is small, the fracture-resisting performance (toughness described below) of the welded joint is not sufficient. In addition, in the method of Patent Document 15, the rolling reduction ratio of the plate thickness after the final rolling to the plate thickness of the cast slab is small, and conditions such as the rolling reduction or temperature in the first rolling process are not controlled. Therefore, the fracture-resisting performance (toughness described below) of the base metal and the welded joint is not sufficient due to microstructure coarsening and segregation remaining. As such, it is difficult to secure the fracture-resisting performance at approximately −160° C. in the steel plate in which the amount of Ni is reduced to approximately 6% using the existing techniques.

CITATION LIST

Patent Literature

[Patent Document 1] Japanese Unexamined Patent Application, First Publication No. H07-278734

[Patent Document 2] Japanese Unexamined Patent Application, First Publication No. H06-179909

[Patent Document 3] Japanese Unexamined Patent Application, First Publication No. S63-130245

[Patent Document 4] Japanese Unexamined Patent Application, First Publication No. H09-143557

[Patent Document 5] Japanese Unexamined Patent Application, First Publication No. H04-107219

[Patent Document 6] Japanese Unexamined Patent Application, First Publication No. S56-156715

[Patent Document 7] Japanese Unexamined Patent Application, First Publication No. 2002-129280

[Patent Document 8] Japanese Unexamined Patent Application, First Publication No. H04-371520

[Patent Document 9] Japanese Unexamined Patent Application, First Publication No. S61-133312

[Patent Document 10] Japanese Unexamined Patent Application, First Publication No. H07-316654

[Patent Document 11] Japanese Examined Patent Application, Second Publication No. H04-14179

[Patent Document 12] Japanese Unexamined Patent Application, First Publication No. H09-20922

[Patent Document 13] Japanese Unexamined Patent Application, First Publication No. H09-41036

[Patent Document 14] Japanese Unexamined Patent Application, First Publication No. 1109-41088

[Patent Document 15] Japanese Unexamined Patent Application, First Publication No. 2000-129351

Non Patent Document

[Non Patent Document 1] Iron and Steel, 59$^{th}$ year, 1973, Vol. 6, p. 752

SUMMARY OF INVENTION

Technical Problem

An object of the invention is to provide a steel plate that is excellent in fracture-resisting performance at approximately −160° C. with Ni content of approximately 6% and a method of manufacturing the same.

Solution to Problem

The present invention provides a steel plate that is excellent in fracture-resisting performance at approximately −160° C.

with Ni content of approximately 6% and a method of manufacturing the same. An aspect is as follows.

(1) A Ni-added steel plate according to an aspect of the invention contains, by mass %, C: 0.03% to 0.10%, Si: 0.02% to 0.40%, Mn: 0.3% to 1.2%, Ni: 5.0% to 7.5%, Cr: 0.4% to 1.5%, Mo: 0.02% to 0.4%, Al: 0.01% to 0.08%, T.O: 0.0001% to 0.0050%, P: limited to 0.0100% or less, S: limited to 0.0035% or less, N: limited to 0.0070% or less, and the balance consisting on iron and unavoidable impurities, in which a Ni segregation ratio at a position of ¼ of a plate thickness away from a plate surface in a thickness direction is 1.3 or less, a fraction of an austenite after a deep cooling is 2% or more, an austenite unevenness index after the deep cooling is 5.0 or less, and an average equivalent circle diameter of the austenite after the deep cooling is 1 μm or less.

(2) The Ni-added steel plate according to the above (1) may further contain, by mass %, at least one of Cu: 1.0% or less, Nb: 0.05% or less, Ti: 0.05% or less, V: 0.05% or less, B: 0.05% or less, Ca: 0.0040% or less, Mg: 0.0040% or less, and REM: 0.0040% or less.

(3) In the Ni-added steel plate according to the above (1) or (2), the Ni may be 5.3% to 7.3%.

(4) In the Ni-added steel plate according to the above (1) or (2), a plate thickness may be 4.5 mm to 80 mm.

(5) In a method of manufacturing a Ni-added steel plate according to another aspect of the invention, a first thermal processing treatment in which a slab containing, by mass %, C: 0.03% to 0.10%, Si: 0.02% to 0.40%, Mn: 0.3% to 1.2%, Ni: 5.0% to 7.5%, Cr: 0.4% to 1.5%, Mo: 0.02% to 0.4%, Al: 0.01% to 0.08%, T.O: 0.0001% to 0.0050%, P: limited to 0.0100% or less, S: limited to 0.0035% or less, N: limited to 0.0070% or less, and the balance consisting of iron and unavoidable impurities is held at a heating temperature of 1250° C. to 1380° C. for 8 hours to 50 hours, and thereafter an air-cooling to 300° C. or lower is performed; a second thermal processing treatment in which the slab is heated to 900° C. to 1270° C., a hot rolling is performed by a rolling reduction of 2.0 to 40 with controlling a temperature before a final pass to 660° C. to 900° C., and, immediately, a cooling is performed; a third thermal processing treatment in which the slab is heated to 600° C. to 750° C., and thereafter a cooling is performed; and a fourth thermal processing treatment in which the slab is heated to 500° C. to 650° C., and thereafter a cooling is performed.

(6) In the method of manufacturing the Ni-added steel plate according to the above (5), the slab may further contain, by mass %, at least one of Cu: 1.0% or less, Nb: 0.05% or less, Ti: 0.05% or less, V: 0.05% or less, B: 0.05% or less, Ca: 0.0040% or less, Mg: 0.0040% or less, and REM: 0.0040% or less.

(7) In the method of manufacturing the Ni-added steel plate according to the above (5) or (6), in the first thermal processing treatment, before the air cooling, a hot rolling may be performed by a rolling reduction of 1.2 to 40 with controlling a temperature before a final pass to 800° C. to 1200° C.

(8) In the method of manufacturing the Ni-added steel plate according to the above (5) or (6), in the second thermal processing treatment, after the hot rolling and the cooling, a reheating to 780° C. to 900° C. is performed.

(9) In the method of manufacturing the Ni-added steel plate according to the above (5) or (6), in the first thermal processing treatment, before the air cooling, a hot rolling may be performed by a rolling reduction of 1.2 to 40 with controlling a temperature before a final pass to 800° C. to 1200° C., and, in the second thermal processing treatment, after the hot rolling and the cooling, a reheating to 780° C. to 900° C. is performed.

Advantageous Effects of Invention

According to the present invention, it is possible to secure fracture-resisting performance at approximately −160° C. in a steel material having steel components among which Ni is reduced to approximately 6%. That is, the present invention can provide a steel plate for which the costs are significantly low compared to the 9% Ni steel in the past and a method of manufacturing the same, and which has a high industrial applicability.

DESCRIPTION OF EMBODIMENTS

Figure 1:
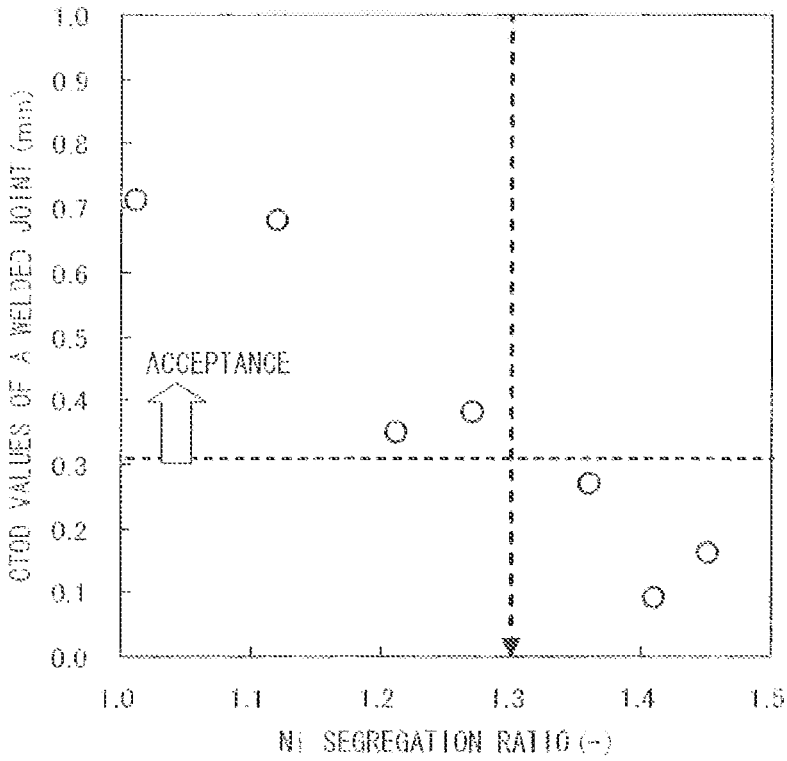
FIG. 1 is a graph showing a relationship between toughness of a welded joint and a Ni segregation ratio.

The present inventors found that three kinds of fracture-resisting performance are important as characteristics (characteristics of a base metal and a welded joint) necessary for a steel plate used for a welded structure such as a LNG tank. Hereinafter, as the fracture-resisting performance of the invention, a characteristic that prevents occurrence of brittle fracture (cracking) is defined to be toughness, a characteristic that stops propagation of the brittle fracture (cracking) is defined to be arrestability, and a characteristic that suppresses unstable fracture (fracture type including ductile fracture) is defined to be unstable fracture-suppressing characteristic. The three kinds of fracture-resisting performance are evaluated for both the base metal and the welded joint of the steel plate.

The invention will be described in detail.

At first, a background which resulted in the invention will be described. The inventors thoroughly studied methods of manufacturing a steel material that is excellent in fracture-resisting performance at approximately −160° C. in a case in which, among steel components, Ni is reduced to approximately 6%. As a result of the studies, it was confirmed that a two-phase region thermal treatment is important. However, it was found that, with only the two-phase region thermal treatment, the characteristics of steel material are not sufficient, and the toughness and the arrestability of the welded joint and the unstable fracture-suppressing characteristic of the welded joint as well as the arrestability of base metal are insufficient. Furthermore, the inventors thoroughly carried out studies for enhancing the above characteristics, and found that the unevenness of alloy elements in the steel plate has a large influence on the toughness and the arrestability of the welded joint and the arrestability of base metal. In a case in which the unevenness of alloy elements is large, in the base metal of steel, the distribution of residual austenite becomes uneven, and a performance that stops the propagation of the brittle cracking (arrestability) degrades. In the welded joint of steel, hard martensite is generated in some of a portion heated to the two-phase region temperature due to thermal influences of welding in a state in which the martensite is packed in an island shape, and the performance that inhibits occurrence of brittle cracking (toughness) and the performance that stops propagation of brittle cracking (arrestability) significantly degrade.

In general, in a case in which fracture characteristics are affected by the unevenness of alloy elements, central segregation in the vicinity of a central portion of the steel plate in the plate thickness direction (depth direction) becomes a problem. This is because the brittle central segregation portion in a material and the plate thickness central portion in the plate thickness direction at which stress triaxiality (stress state) dynamically increases overlap so as to preferentially cause brittle fracture. However, among steels used for LNG tanks, an austenite-based alloy is used as a welding material in most cases. In this case, since a welded joint shape in which the austenite-based alloy that does not brittlely fracture is present to a large extent in the plate thickness central portion is used, there is a little possibility of brittle fracture caused by central segregation.

Therefore, the inventors studied the relationship between micro segregation and fracture performance against brittle fracture (toughness and arrestability). As a result, the inventors obtained extremely important knowledge that micro segregation occurs across the entire thickness of the steel material, and thus has a large influence on a performance that inhibits occurrence of brittle fracture (toughness) and a performance that stops propagation (arrestability) through the structural changes of the base metal and weld heat-affected zones. The micro segregation is a phenomenon in which an alloy-enriched portion is formed in residual molten steel between dendrite secondary arms during solidification, and the alloy-enriched portion is extended through rolling. The inventors succeeded in reducing the unevenness of alloy elements and significantly improving the toughness and arrestability of welded joint and the arrestability of base metal by carrying out thermal processing treatments several times under predetermined conditions.

As such, the steel plate that was excellent in the toughness and arrestability of the base metal and the welded joint could be manufactured by reducing the unevenness of alloy elements in addition to the two-phase region thermal treatment. However, in order to use the steel plate for an LNG tank, the unstable fracture-suppressing characteristic of the welded joint is required in addition to the fracture-resisting performance, and it became evident that, in the above method, the unstable fracture-suppressing characteristic was not sufficient. The inventors thoroughly studied methods to enhance the unstable fracture-suppressing characteristic. As a result, it was found that the unstable fracture-suppressing characteristic is not sufficient when only residual austenite is present in the base metal in a large fraction and evenly, and it is necessary that the respective residual austenite grains are fine. Therefore, the inventors succeeded in enhancing the unstable fracture-suppressing characteristic by optimizing conditions of hot rolling and controlled cooling and finely dispersing residual austenite.

As such, it became evident that the toughness and arrestability of the base metal, and the toughness, arrestability, and unstable fracture-suppressing characteristic of the welded joint are all excellent when solute elements are evenly distributed, residual austenite is dispersed in a large fraction and evenly, and the respective residual austenite grains are miniaturized in addition to the two-phase region thermal treatment.

Hereinafter, the ranges of alloy elements in steel will be specified. Meanwhile, hereinafter, "%" indicates "mass %."

Ni is an effective element for improving the fracture-resisting performance of base metal and welded joint. When the amount of Ni is less than 5.0%, the amount of fracture-resisting performance enhanced due to stabilization of Ni solid solution and residual austenite is not sufficient, and, when the amount of Ni exceeds 7.5%, alloying costs increase. Therefore, the amount of Ni is limited to 5.0% to 7.5%. Meanwhile, in order to further enhance the fracture-resisting performance, the lower limit of the amount of Ni may be limited to 5.3%, 5.6%, 5.8%, or 6.0%. In addition, in order to decrease alloying costs, the upper limit of the amount of Ni may be limited to 7.3%, 7.0%, 6.8%, or 6.5%.

The most important element to compensate for degradation of fracture-resisting performance due to reduction of Ni is Mn. Similarly to Ni, Mn stabilizes residual austenite so as to improve the fracture-resisting performance of base metal and welded joint. Therefore, it is necessary to add Mn to steel at a minimum of 0.3% or more. However, when more than 1.2% of Mn is added to steel, micro segregation and tempering embrittlement sensitivity increases, and fracture-resisting performance degrades. Therefore, the amount of Mn is limited to 0.3% to 1.2%. Meanwhile, in order to improve fracture-resisting performance by reducing the amount of Mn, the lower limit of the amount of Mn may be limited to 1.15%, 1.1%, 1.0%, or 0.95%. In order to stabilize residual austenite, the lower limit of the amount of Mn may be limited to 0.4%, 0.5%, 0.6%, or 0.7%.

Cr is also an important element in the invention. Cr is important for securing strength, and has an effect of increasing strength without significantly degrading the toughness and arrestability of the welded joint. In order to secure the strength of the base metal, it is necessary to include Cr in steel at a minimum of 0.4% or more. However, when more than 1.5% of Cr is included in steel, the toughness of welded joint degrades. Therefore, the amount of Cr is limited to 0.4% to 1.5%. Meanwhile, in order to increase strength, the lower limit of the amount of Cr may be limited to 0.5%, 0.55%, or 0.6%. In order to improve the toughness of welded joint, the upper limit of the amount of Cr may be limited to 1.3%, 1.0%, 0.9%, or 0.8%.

Mo is also an important element in the invention. In a case in which some of Ni is substituted by Mn, tempering embrittlement sensitivity increases together with an increase in Mn. Mo can decrease the tempering embrittlement sensitivity. When the amount of Mo is less than 0.02%, an effect of decreasing the tempering embrittlement sensitivity is small, and, when the amount of Mo exceeds 0.4%, manufacturing costs increase, and the toughness of welded joint degrades. Therefore, the amount of Mo is limited to 0.02% to 0.4%. Meanwhile, in order to decrease tempering embrittlement sensitivity, the lower limit of the amount of Mo may be limited to 0.05%, 0.08%, 0.1%, or 0.13%. In order to improve the toughness of welded joint, the upper limit of the amount of Mo may be limited to 0.35%, 0.3%, or 0.25%.

Since C is an essential element for securing strength, the amount of C is set to 0.03% or more. However, when the amount of C increases, the toughness and weldability of base metal degrade due to generation of coarse precipitates, and therefore the upper limit of the amount of C is set to 0.10%. That is, the amount of C is limited to 0.03% to 0.10%. Meanwhile, in order to improve strength, the lower limit of the amount of C may be limited to 0.04% or 0.05%. In order to improve the toughness and weldability of base metal, the upper limit of the amount of C may be limited to 0.09%, 0.08%, or 0.07%.

Since Si is an essential element for securing strength, the amount of Si is set to 0.02% or more. However, when the amount of Si increases, weldability degrades, and therefore the upper limit of the amount of Si is set to 0.40%. That is, the amount of Si is limited to 0.02% to 0.40%. Meanwhile, when the amount of Si is set to 0.12% or less or 0.08% or less, tempering embrittlement sensitivity degrades, and the fracture-resisting performance of base metal and welded joint improve, and therefore the upper limit of the amount of Si may be limited to 0.12% or less or 0.08% or less.

P is an element that is unavoidably included in steel, and degrades the fracture-resisting performance of base metal. When the amount of P exceeds 0.0100%, the fracture-resisting performance of base metal degrades due to acceleration of tempering embrittlement. Therefore, the amount of P is limited to 0.0100% or less. In order to improve the fracture-resisting performance of base metal, the upper limit of the amount of P may be limited to 0.0060%, 0.0050%, or 0.0040%. Meanwhile, when the amount of P is 0.0010% or less, productivity significantly degrades due to an increase in refining loads, and therefore it is not necessary to decrease the content of phosphorous to 0.0010% or less. However, since the effects of the invention can be exhibited even when the amount of P is 0.0010% or less, it is not particularly necessary to limit the lower limit of the amount of P, and the lower limit of the amount of P is 0%.

S is an element that is unavoidably included in steel, and degrades the fracture-resisting performance of base metal. When the amount of S exceeds 0.0035%, the toughness of base metal degrades. Therefore, the amount of S is limited to 0.0035% or less. In order to improve the fracture-resisting performance of base metal, the upper limit of the amount of S may be limited to 0.0030%, 0.0025%, or 0.0020%. When the amount of S is less than 0.0001%, productivity significantly degrades due to an increase in refining loads, and therefore it is not necessary to decrease the content of sulfur to less than 0.0001%. However, since the effects of the invention can be exhibited even when the amount of S is less than 0.0001%, it is not particularly necessary to limit the lower limit of the amount of S, and the lower limit of the amount of S is 0%.

Al is an effective element as a deoxidizing material. Since deoxidation is not sufficient when less than 0.01% of Al is included in steel, the toughness of base metal degrades. When more than 0.08% of Al is included in steel, the toughness of welded joint degrades. Therefore, the amount of Al is limited to 0.01% to 0.08%. In order to reliably carry out deoxidation, the lower limit of the amount of Al may be limited to 0.015%, 0.02%, or 0.025%. In order to improve the toughness of welded joint, the upper limit of the amount of Al may be limited to 0.06%, 0.05%, or 0.04%.

N is an element that is unavoidably included in steel, and degrades the fracture-resisting performance of base metal and welded joint. When the amount of N is less than 0.0001%, productivity significantly degrades due to an increase in refining loads, and therefore it is not necessary to carry out denitrification to less than 0.0001%. However, since the effects of the invention can be exhibited even when the amount of N is less than 0.0001%, it is not particularly necessary to limit the lower limit of the amount of N, and the lower limit of the amount of N is 0%. When the amount of N exceeds 0.0070%, the toughness of base metal and the toughness of welded joint degrade. Therefore, the amount of N is limited to 0.0070% or less. In order to improve toughness, the upper limit of the amount of N may be limited to 0.0060%, 0.0050%, or 0.0045%.

T.O is unavoidably included in steel, and degrades the fracture-resisting performance of base metal. When the amount of T.O is less than 0.0001%, refining loads are extremely high, and productivity degrades. In a case in which the amount of T.O exceeds 0.0050%, the toughness of base metal degrades. Therefore, the amount of T.O is limited to 0.0001% to 0.0050%. Meanwhile, when the amount of T.O is set to 0.0025% or less or 0.0015% or less, the toughness of base metal significantly improves, and therefore the upper limit of the amount of T.O is preferably set to 0.0025% or less or 0.0015% or less. Meanwhile, the amount of T.O is the total of oxygen dissolved in molten steel and oxygen in fine deoxidizing products suspended in the molten steel. That is, the amount of T.O is the total of oxygen that forms a solid solution in steel and oxygen in oxides dispersed in steel.

Meanwhile, a chemical composition that includes the above basic chemical composition (basic elements) with a remainder composed of Fe and inevitable impurities is the basic composition of the invention. However, in the invention, the following elements (optional elements) may be further included according to necessity (instead of some of Fe in the remainder) in addition to the basic composition. Meanwhile, the effects of the present embodiment are not impaired even when the optional elements are unavoidably incorporated into steel.

Cu is an effective element for increasing strength, and may be added according to necessity. An effect of improving the strength of base metal is small when less than 0.01% of Cu is included in steel. When more than 1.0% of Cu is included in steel, the toughness of welded joint degrades. Therefore, in a case in which Cu is added, the amount of Cu is preferably limited to 0.01% to 1.0%. In order to improve the toughness of welded joint, the upper limit of the amount of Cu may be limited to 0.5%, 0.3%, 0.1%, or 0.05%. Meanwhile, in order to reduce alloying costs, intentional addition of Cu is not desirable, and the lower limit of Cu is 0%.

Nb is an effective element for improving strength, and may be added according to necessity. An effect of improving the strength of base metal is small even when less than 0.001% of Nb is included in steel. When more than 0.05% of Nb is included in steel, the toughness of welded joint degrades. Therefore, in a case in which Nb is added, the amount of Nb is preferably limited to 0.001% to 0.05%. In order to improve the toughness of welded joint, the upper limit of the amount of Nb may be limited to 0.03%, 0.02%, 0.01%, or 0.005%. Meanwhile, in order to reduce alloying costs, intentional addition of Nb is not desirable, and the lower limit of Nb is 0%.

Ti is an effective element for improving the toughness of base metal, and may be added according to necessity. An effect of improving the toughness of base metal is small even when less than 0.001% of Ti is included in steel. In a case in which Ti is added, when more than 0.05% of Ti is included in steel, the toughness of welded joint degrades. Therefore, the amount of Ti is preferably limited to 0.001% to 0.05%. In order to improve the toughness of welded joint, the upper limit of the amount of Ti may be limited to 0.03%, 0.02%, 0.01%, or 0.005%. Meanwhile, in order to reduce alloying costs, intentional addition of Ti is not desirable, and the lower limit of Ti is 0%.

V is an effective element for improving the strength of base metal, and may be added according to necessity. An effect of improving the strength of base metal is small even when less than 0.001% of V is included in steel. When more than 0.05% of V is included in steel, the toughness of welded joint degrades. Therefore, in a case in which V is added, the amount of V is preferably limited to 0.001% to 0.05%. In order to improve the toughness of welded joint, the upper limit of the amount of V may be limited to 0.03%, 0.02%, or 0.01%. Meanwhile, in order to reduce alloying costs, intentional addition of V is not desirable, and the lower limit of V is 0%.

B is an effective element for improving the strength of base metal, and may be added according to necessity. An effect of improving the strength of base metal is small even when less than 0.0002% of B is included in steel. When more than 0.05% of B is included in steel, the toughness of base metal degrades. Therefore, in a case in which B is added, the amount of B is preferably limited to 0.0002% to 0.05%. In order to improve the toughness of base metal, the upper limit of the amount of B may be limited to 0.03%, 0.01%, 0.003%, or 0.002%. Meanwhile, in order to reduce alloying costs, intentional addition of B is not desirable, and the lower limit of B is 0%.

Ca is an effective element for preventing the clogging of a nozzle, and may be added according to necessity. An effect of preventing the clogging of the nozzle is small even when less than 0.0003% of Ca is included in steel. When more than 0.0040% of Ca is included in steel, the toughness of base metal degrades. Therefore, in a case in which B is added, the amount of Ca is preferably limited to 0.0003% to 0.0040%. In order to prevent degradation of the toughness of base metal, the upper limit of the amount of Ca may be limited to 0.0030%, 0.0020%, or 0.0010%. Meanwhile, in order to reduce alloying costs, intentional addition of Ca is not desirable, and the lower limit of Ca is 0%.

Mg is an effective element for improving toughness, and may be added according to necessity. An effect of improving the strength of base metal is small even when less than 0.0003% of Mg is included in steel. When more than 0.0040% of Mg is included in steel, the toughness of base metal degrades. Therefore, in a case in which Mg is added, the amount of Mg is preferably limited to 0.0003% to 0.0040%. In order to prevent degradation of the toughness of base metal, the upper limit of the amount of Mg may be limited to 0.0030%, 0.0020%, or 0.0010%. Meanwhile, in order to reduce alloying costs, intentional addition of Mg is not desirable, and the lower limit of Mg is 0%.

REM (rare earth metals) are effective elements for preventing the clogging of a nozzle, and may be added according to necessity. An effect of preventing the clogging of the nozzle is small even when less than 0.0003% of REM is included in steel. When more than 0.0040% of REM is included in steel, the toughness of base metal degrades. Therefore, in a case in which REM is added, the amount of REM is preferably limited to 0.0003% to 0.0040%. In order to prevent degradation of the toughness of base metal, the upper limit of the amount of REM may be limited to 0.0030%, 0.0020%, or 0.0010%. Meanwhile, in order to reduce alloying costs, intentional addition of REM is not desirable, and the lower limit of REM is 0%.

Meanwhile, elements which are unavoidable impurities in raw materials that include the alloying elements to be used and are unavoidable impurities that are eluted from heat-resistant materials such as furnace materials during melting may be included in steel at less than 0.002%. For example, Zn, Sn, Sb, and Zr which can be incorporated while melting steel may be included in steel at less than 0.002% respectively (since Zn, Sn, Sb, and Zr are inevitable impurities incorporated according to the melting conditions of steel, the content includes 0%). Effects of the invention are not impaired even when the above elements are included in steel at less than 0.002% respectively.

As described above, the Ni-added steel plate of the invention has a chemical composition including the above basic elements with the remainder composed of Fe and inevitable impurities or a chemical composition including the above basic elements and at least one selected from the above optional elements with the remainder composed of Fe and inevitable impurities.

In the invention, as described above, even distribution of solute elements in steel is extremely important. Specifically, reduction of the banded segregation of solute elements such as Ni is effective for improvement of the toughness and arrestability of welded joint. The banded segregation refers to a banded form (banded area) in which a portion of solute elements concentrated in residual molten steel between dendrite arms at the time of solidification are extended in parallel in a rolling direction through hot rolling. That is, in the banded segregation, portions in which solute elements are concentrated and portions in which solute elements are not concentrated are alternately formed in a band shape at intervals of, for example, 1 μm to 100 μm. Unlike central segregation that is formed at a slab central portion, the banded segregation, in general (for example, at room temperature), does not act as a major cause of a decrease in toughness. However, in steels having a small amount of Ni of approximately 6% to 7% which is used at an extremely low temperature of −160° C., the banded segregation has an extremely large influence. When solute elements such as Ni, Mn, and P are unevenly present in steel due to the banded segregation, the stability of residual austenite generated during a thermal processing treatment significantly varies depending on places (locations in steel). Therefore, in a base metal, the propagation stopping performance (arrestability) of brittle fracture significantly degrades. In addition, in the case of a welded joint, when banded areas in which solute elements such as Ni, Mn, and P are concentrated are affected by welding heat, island-shaped martensite packed along the banded area is generated. Since the island-shaped martensite fractures at a low stress, the toughness and arrestability of the welded joint degrade.

The inventors firstly investigated the relationship between Ni segregation ratios and the toughness and arrestability of a welded joint. As a result, it was found that, in a case in which the Ni segregation ratio at a position of ¼ of the plate thickness away from the steel plate surface in the plate thickness direction (depth direction) (hereinafter referred to as the ¼ t portion) is 1.3 or less, the toughness and arrestability of a welded joint are excellent. Therefore, the Ni segregation ratio at the ¼ t portion is limited to 1.3 or less. Meanwhile, in a case in which the Ni segregation ratio at the ¼ t portion is 1.15 or less, the toughness and arrestability of welded joint are excellent, and therefore the Ni segregation ratio is preferably set to 1.15 or less.

The Ni segregation ratio at the ¼ t portion can be measured through electron probe microanalysis (EPMA). That is, the amounts of Ni are measured through EPMA at intervals of 2 μm across a length of 2 mm in the plate thickness direction centered on a location which is ¼ of the plate thickness away from the steel plate surface (plate surface) in the plate thickness direction (depth direction). Among data of the amounts of Ni measured at 1000 points, the data of the 10 largest amounts of Ni and the data of the 10 smallest amounts of Ni are excluded from evaluation data as abnormal values. The average of the remaining data at 980 points is defined to be the average value of the amount of Ni, and, among the data at 980 points, the average of the 20 data points with the highest Ni content is defined to be the maximum value of the amount of Ni. A value obtained by dividing the maximum value of the amount of Ni by the average value of the amount of Ni is defined to be the Ni segregation ratio at the ¼ t portion. The lower limit value of the Ni segregation ratio statistically becomes 1.0. Therefore, the lower limit of the Ni segregation ratio may be 1.0. Meanwhile, in the invention, in a case in which the result (CTOD value $\delta_c$) of a crack tip opening displacement (CTOD) test of a welded joint at −165° C. is 0.3 mm or more, the toughness of the welded joint is evaluated to be excellent. In addition, in a duplex ESSO test of welded joint which is carried out under conditions of a test temperature of −165° C. and a load stress of 392 MPa, in a case in which the entry distance of brittle cracking in a test plate is twice or less the plate thickness, the arrestability of the welded joint is evaluated to be excellent. In contrast, in a case in which brittle cracking stops in the middle of the test plate, but the entry distance of the brittle cracking in the test plate is twice or more the plate thickness and a case in which brittle cracking penetrates the test plate, the arrestability of the welded joint is evaluated to be poor.

Figure 2:
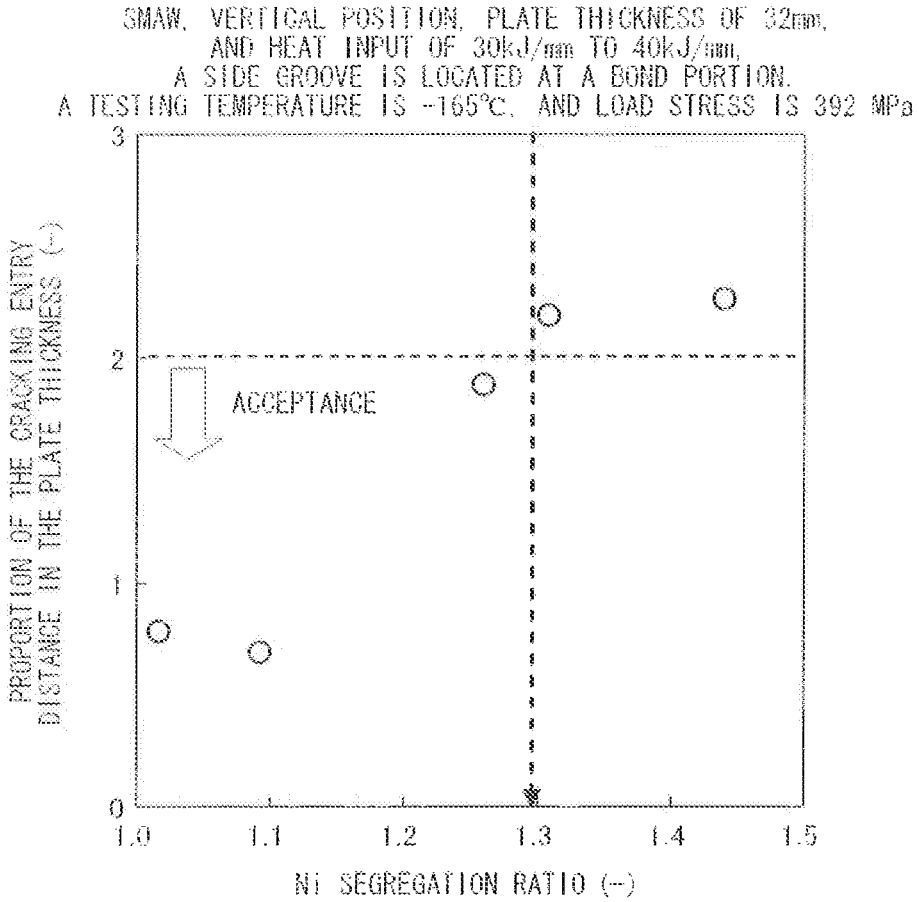
FIG. 2 is a graph showing a relationship between arrestability of the welded joint and the Ni segregation ratio.

FIG. 1 shows the relationship between the Ni segregation ratio and the CTOD value of a welded joint at −165° C. As shown in FIG. 1, when the Ni segregation ratio is 1.3 or less, the CTOD value of the welded joint is 0.3 mm or more, and the toughness of the welded joint is excellent. In addition, FIG. 2 shows the relationship between the Ni segregation ratio and the proportion of the cracking entry distance in the plate thickness (measured values of the duplex ESSO test under the above conditions). As shown in FIG. 2, when the Ni segregation ratio is 1.3 or less, the cracking entry distance becomes twice the plate thickness or less, and the arrestability of the welded joint is excellent. The welded joint used in the CTOD test of FIG. 1 and the duplex ESSO test of FIG. 2 was manufactured under the following conditions using shield metal arc welding (SMAW). That is, the SMAW was carried out through vertical position welding under conditions of a heat input of 3.0 kJ/cm to 4.0 kJ/cm and a preheating temperature and an interpass temperature of 100° C. or lower. Meanwhile, a notch is located at a bond portion.

Next, the inventors investigated the relationship between residual austenite after deep cooling and the arrestability of a base metal. That is, the inventors defined the ratio of the maximum area fraction to the minimum area fraction of the residual austenite after deep cooling to be an austenite unevenness index after deep cooling (hereinafter sometimes also referred to as the unevenness index), and investigated the relationship between the index and the arrestability of base metal. As a result, it was found that, when the austenite unevenness index after deep cooling exceeds 5.0, the arrestability of the base metal degrades. Therefore, in the invention, the austenite unevenness index after deep cooling is limited to 5.0 or less. The lower limit of the austenite unevenness index after deep cooling is statistically 1. Therefore, the austenite unevenness index after deep cooling in the invention may be 1.0 or more. Meanwhile, the maximum area fraction and minimum area fraction of austenite can be evaluated from the electron back scattering pattern (EBSP) of a sample which is deep-cooled in liquid nitrogen. Specifically, the area fraction of austenite is evaluated by mapping the EBSP in a 5×5 μm area. The area fraction is continuously evaluated at a total of 40 points centered on a location which is the ¼ t portion of the steel plate in the plate thickness direction. Among the data at all 40 points, the average of the 5 data points with the largest area fractions of austenite is defined to be the maximum area fraction, and the average of the 5 data points with the smallest area fractions of austenite is defined to be the minimum area fraction. Furthermore, a value obtained by dividing the maximum area fraction by the minimum area fraction is defined to be the austenite unevenness index after deep cooling. Meanwhile, since it is not possible to investigate the above micro unevenness of austenite by X-ray diffraction described below, EBSP is used.

The absolute fraction of the residual austenite is also important. When the amount of the residual austenite after deep cooling (hereinafter sometimes also referred to as the amount of austenite) is below 2% of the amount of the entire microstructure, the toughness and arrestability of base metal significantly degrade. Therefore, the fraction of austenite after deep cooling is 2% or more. In addition, when the fraction of the residual austenite after deep cooling significantly increases, the austenite becomes unstable under plastic deformation, and, conversely, the toughness and arrestability of the base metal degrade. Therefore, the fraction of austenite after deep cooling is preferably 2% to 20%. Meanwhile, the fraction of the residual austenite after deep cooling can be measured by deep cooling a sample taken from the ¼ t portion of a steel plate in liquid nitrogen for 60 minutes, and then carrying out an X-ray diffraction of the sample at room temperature. Meanwhile, in the present invention, a treatment in which a sample is immersed in liquid nitrogen and held for at least 60 minutes is referred to as a deep cooling treatment.

Furthermore, as described above, it is also extremely important that the residual austenite is fine. Even in a case in which the fraction of the residual austenite after deep cooling is 2% to 20%, and the unevenness index is 1.0 to 5.0, when the residual austenite is coarse, unstable fracture is liable to occur at the welded joint. In a case in which once-stopped cracking propagates again across the entire cross section in the plate thickness direction due to unstable fracture, the base metal is included in some of the propagation path of the cracking. Therefore, when the stability of austenite in the base metal decreases, unstable fracture becomes liable to occur. That is, when the residual austenite becomes coarse, the amount of C included in the residual austenite decreases, and therefore the stability of the residual austenite degrades. In a case in which the average of the equivalent circle diameter (average equivalent circle diameter) of the austenite after deep cooling is 1 μm or more, unstable fracture becomes liable to occur. Therefore, in order to obtain a sufficient unstable fracture-suppressing characteristic, the average equivalent circle diameter of the residual austenite after deep cooling is limited to 1 μm or less. Meanwhile, unstable fracture (unstable ductile fracture) is a phenomenon in which brittle fracture occurs, propagates, then stops, and then the fracture propagates again. The forms of the unstable fracture include a case in which the entire fractured surface is a ductile-fractured surface, and a case in which the surfaces in the vicinity of both end portions (both surfaces) of the plate thickness in the fractured surface are ductile-fractured surfaces, and the surface in the vicinity of the central portion of the plate thickness in the fractured surface are a brittle-fractured surface. Meanwhile, the average equivalent circle diameter of the austenite after deep cooling can be obtained by, for example, observing dark-field images at 20 places using a transmission electron microscope at a magnification of 10000 times, and quantifying the average equivalent circle diameter. The lower limit of the average equivalent circle diameter of the austenite after deep cooling may be, for example, 1 nm.

Therefore, the steel plate of the invention is excellent in fracture-resisting performance at approximately −160° C., and can be generally used for welded structures such as ships, bridges, constructions, marine structures, pressure vessels, tanks, and line pipes. Particularly, the steel plate of the invention is effective in a case in which the steel plate is used as an LNG tank which demands fracture-resisting performance at an extremely low temperature of approximately −160° C.

Next, the method of manufacturing a Ni-added steel plate of the invention will be described. In a first embodiment of the method of manufacturing a Ni-added steel plate of the invention, a steel plate is manufactured using a manufacturing process including a first thermal processing treatment (band segregation reduction treatment), a second thermal processing treatment (hot rolling and a controlled cooling treatment), a third thermal processing treatment (high-temperature two-phase region treatment), and a fourth thermal processing treatment (low-temperature two-phase region treatment). Furthermore, as shown in a second embodiment of the method of manufacturing a Ni-added steel plate of the invention, in the first thermal processing treatment (band segregation reduction treatment), hot rolling may be carried out after a thermal treatment (heating) as described below. Here, a process in which treatments such as hot rolling and controlled cooling are combined according to necessity is defined to be the thermal processing treatment with respect to a thermal treatment at a high temperature which is a basic treatment. In addition, a slab within a range of the above alloy elements (the above steel components) is used in the first thermal processing treatment.

Hereinafter, the first embodiment of the method of manufacturing a Ni-added steel plate of the invention will be described.

First Embodiment

Firstly, the third thermal processing treatment (high-temperature two-phase region treatment) will be described. The thermal processing treatment is an essential process for enhancing the toughness and arrestability of a base metal at approximately −160° C. in a steel for which the amount of Ni is reduced to approximately 6%. In the thermal processing treatment, reverse-transformed austenite is generated along the grain boundaries of old austenite and the interfaces of packets, blocks, laths, and the like of martensite in a needle, rod, or sheet shape so as to miniaturize the microstructure. Furthermore, when the reverse-transformed austenite covers the grain boundaries of old austenite, tempering embrittlement sensitivity degrades, and therefore a sufficient effect of improving the toughness and arrestability of a base metal can be achieved. Furthermore, since solute elements concentrate in fine reverse-transformed austenite, the third thermal processing treatment (high-temperature two-phase region treatment) has an effect of finely dispersing extremely thermally stable austenite in the subsequent fourth thermal processing treatment (low-temperature two-phase region treatment). However, since the concentration of the solute element varies in steel even when the two-phase region treatment is carried out on steel in which band segregation is not reduced, the fraction and dimension of the reverse-transformed austenite and the concentration of solutes in the reverse-transformed austenite are liable to vary. Therefore, the effect of improving the fracture-resisting performance of steel varies, and it is not possible to exhibit extremely excellent fracture-resisting performance across the entire steel. Therefore, excellent fracture-resisting performance (the toughness and arrestability of base metal) at −160° C. can be supplied to a steel plate having a small amount of Ni of approximately 6% by combining the band segregation reduction treatment and the high-temperature two-phase region treatment. Temperature management in the third thermal processing treatment (high-temperature two-phase region treatment) is extremely important since the temperature management has an influence on the fraction of the reverse-transformed austenite or diffusion of the solutes in austenite. When the heating temperature is below 600° C. or exceeds 750° C., the fraction of the residual austenite becomes less than 2%, and therefore the toughness and arrestability of a base metal degrade. Therefore, the heating temperature in the high-temperature two-phase region treatment is 600° C. to 750° C. In addition, in a case in which the heating temperature is 650° C. to 700° C., fracture-resisting performance more significantly improve. Therefore, the temperature of the high-temperature two-phase region treatment is preferably 650° C. to 700° C. In the third thermal processing treatment, steel after the second thermal processing treatment is heated to the above heating temperature, and then cooled using water or air. Here, water cooling refers to cooling at a cooling rate of more than 3° C./s at the ¼ t portion in steel plate. The upper limit of the cooling rate of water cooling is not particularly limited.

Figure 3:
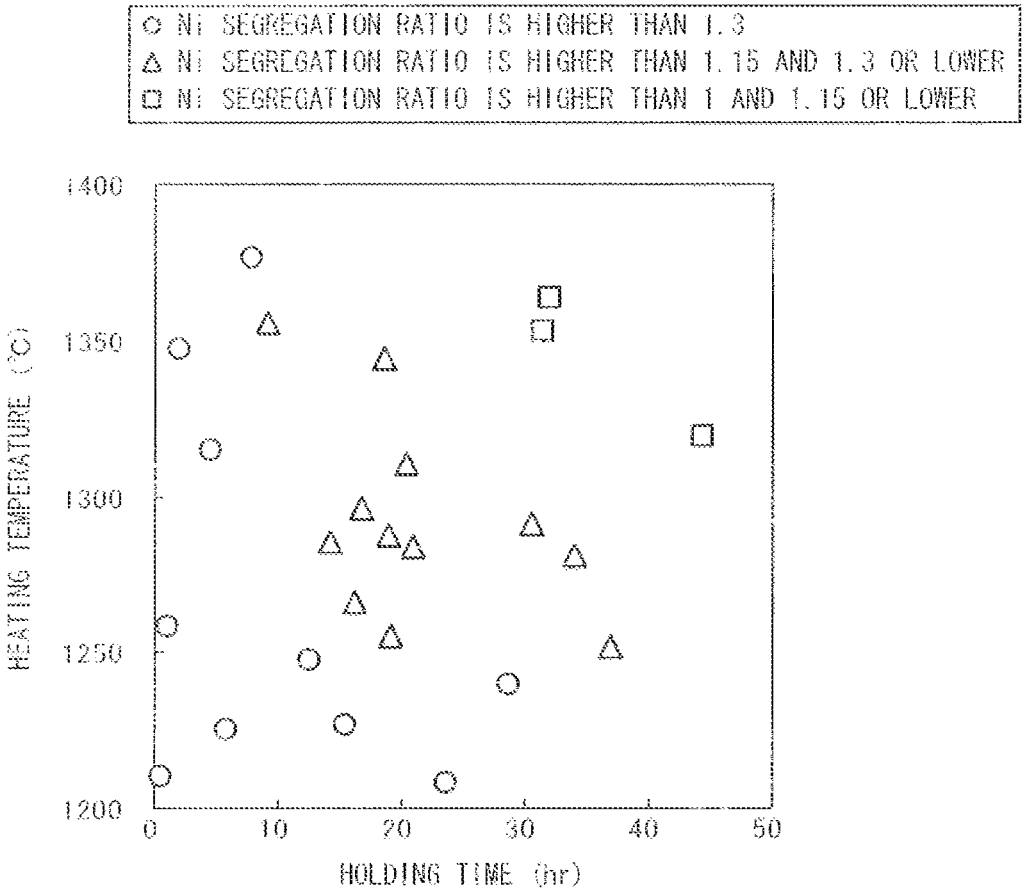
FIG. 3 is an explanatory view showing an influence of a heating time and a holding time on the Ni segregation ratio in a first thermal processing treatment.

Next, the first thermal processing treatment (band segregation reduction treatment) will be described. The thermal processing treatment can reduce the segregation ratio of solute elements and uniformly disperse the residual austenite in steel so as to enhance the toughness and arrestability of welded joint and the arrestability of base metal. In the first thermal processing treatment (band segregation reduction treatment), a thermal treatment is carried out at a high temperature for a long period of time. The inventors investigated the influence of combination of the heating temperature and holding time of the first thermal processing treatment (band segregation reduction treatment) on the Ni segregation ratio. As a result, it was found that, in order to obtain a steel plate having a Ni segregation ratio at the ¼ t portion of 1.3 or less and an austenite unevenness index after deep cooling of 5 or less, it is necessary to hold a slab for 8 hours or more at a heating temperature of 1250° C. or higher as shown in FIG. 3. Therefore, in the first thermal processing treatment (band segregation reduction treatment), the heating temperature is 1250° C. or higher, and the holding time is 8 hours or more. Meanwhile, when the heating temperature is set to 1380° C. or higher, and the holding time is set to 50 hours, productivity significantly degrades, and therefore the heating temperature is limited to 1380° C. or higher, and the holding time is limited to 50 hours or less. Meanwhile, when the heating temperature is set to 1300° C. or higher, and the holding time is set to 30 hours or more, the Ni segregation ratio and the austenite unevenness index further decrease. Therefore, the heating temperature is preferably 1300° C. or higher, and the holding time is preferably 30 hours or more. In the first thermal processing treatment, a slab having the above steel components is heated, held under the above conditions, and then cooled using air. When the temperature at which the process moves from the air cooling to the second thermal processing treatment (tempering treatment) exceeds 300° C., transformation does not complete, and material qualities become uneven. Therefore, the surface temperature (air cooling-end temperature) of a slab at a point in time at which the process moves from the air cooling to the second thermal processing treatment (tempering treatment) is 300° C. or lower. The lower limit of the air cooling-end temperature is not particularly limited. For example, the lower limit of the air cooling-end temperature may be room temperature, or may be −40° C. Meanwhile, the heating temperature refers to the temperature of the surface of a slab, and the holding time refers to a held time after the surface of the slab reaches the set heating temperature, and 3 hours elapses. In addition, the air cooling refers to cooling at a cooling rate of 3° C./s or less while the temperature at the ¼ t portion in the steel plate is from 800° C. to 500° C. In the air cooling, the cooling rate at higher than 800° C. and lower than 500° C. is not particularly limited. The lower limit of the cooling rate of the air cooling may be, for example, 0.01° C./s or more from the viewpoint of productivity.

Next, the second thermal processing treatment (hot rolling and a controlled cooling treatment) will be described. In the second thermal processing treatment, heating, hot rolling (second hot rolling), and controlled cooling are carried out. The treatment can generate a tempered microstructure so as to increase strength and miniaturize the microstructure. Additionally, the unstable fracture-suppressing performance of a welded joint can be enhanced by generating fine stable austenite through introduction of processing strains. In order to generate fine stable austenite, control of the rolling temperature is important. When the temperature before the final pass in the hot rolling becomes low, residual strains increase in steel, and the average equivalent circle diameter of the residual austenite decreases. As a result of investigating the relationship between the average equivalent circle diameter of the residual austenite and the temperature before the final pass, the inventors found that the average equivalent circle diameter becomes 1 μm or less with controlling a temperature before the final pass to 900° C. or lower. In addition, when the temperature before the final pass is 660° C. or higher, the hot rolling can be efficiently carried out without degrading productivity. Therefore, the temperature of the hot rolling during the thermal processing treatment of the second time before the final pass is 660° C. to 900° C. Meanwhile, when the temperature before the final pass is controlled to 660° C. to 800° C., since the average equivalent circle diameter of the residual austenite further decreases, the temperature before the final pass is preferably 660° C. to 800° C. Meanwhile, the temperature before the final pass refers to the temperature of the surface of a slab (billet) measured immediately before engagement (engagement of slab into a rolling roll) of the final pass of the rolling (hot rolling). The temperature before the final pass can be measured using a thermometer such as a radiation thermometer.

It is also important to control the heating temperature before the hot rolling in the second thermal processing treatment (hot rolling and a controlled cooling treatment). The inventors found that, when the heating temperature is set to higher than 1270° C., the fraction of austenite after the deep cooling decreases, and the toughness and arrestability of base metal significantly degrade. In addition, when the heating temperature is lower than 900° C., productivity significantly degrades. Therefore, the heating temperature is 900° C. to 1270° C. Meanwhile, when the heating temperature is set to 1120° C. or lower, the toughness of base metal can be more enhanced. Therefore, the heating temperature is preferably 900° C. to 1120° C. The holding time after the heating is not particularly specified. However, the holding time at the heating temperature is preferably 2 hours to 10 hours from the viewpoint of even heating and securing productivity. Meanwhile, the hot rolling may begin within the holding time.

The rolling reduction of the hot rolling in the second thermal processing treatment (hot rolling and a controlled cooling treatment) is also important. When the rolling reduction increases, the microstructure is miniaturized through recrystallization or an increase in dislocation density after the hot rolling, and final austenite (residual austenite) is also miniaturized. As a result of investigating the relationship between the equivalent circle diameter of austenite after the deep cooling and the rolling reduction, the inventors found that the rolling reduction needs to be 2.0 or more in order to obtain an average equivalent circle diameter of austenite of 1 μm or less. In addition, when the rolling reduction exceeds 40, productivity significantly degrades. Therefore, the rolling reduction of the hot rolling in the second thermal processing treatment is 2.0 to 40. Meanwhile, in a case in which the rolling reduction in the hot rolling in the second thermal processing treatment is 10 or more, the average equivalent circle diameter of austenite further decreases. Therefore, the rolling reduction is preferably 10 to 40. Meanwhile, the rolling reduction in the hot rolling is a value obtained by subtracting the plate thickness after the rolling from the plate thickness before the rolling.

After the hot rolling in the second thermal processing treatment (hot rolling and a controlled cooling treatment), controlled cooling is immediately carried out. In the invention, the controlled cooling refers to cooling controlled for microstructure control, and includes accelerated cooling through water cooling and cooling through air cooling with respect to a steel plate having a plate thickness of 15 mm or less. In a case in which the controlled cooling is carried out through water cooling, the cooling preferably ends at 200° C. or lower. The lower limit of the water cooling-end temperature is not particularly limited. For example, the lower limit of the water cooling-end temperature may be room temperature, or may be −40° C. The immediate controlled cooling can generate a tempered microstructure so as to sufficiently secure the strength of a base metal. Meanwhile, herein, "being immediate" means that, after engagement of the final pass of the rolling, the accelerated cooling preferably begins within 150 seconds or less, and the accelerated cooling more preferably begins within 120 seconds or within 90 seconds. In addition, when the water cooling ends at 200° C., the strength of a base metal can be more reliably secured. In addition, the water cooling refers to cooling at a cooling rate of more than 3° C./s at the ¼ t portion in the steel plate. The upper limit of the cooling rate of the water cooling does not need to be particularly limited.

As such, in the second thermal processing treatment, the slab after the first thermal processing treatment is heated to the above heating temperature, and the temperature before the final pass is controlled to be within the above temperature range so that the hot rolling is performed by the above rolling reduction, and the controlled cooling is immediately carried out, thereby cooling the slab to the above temperature.

Next, the fourth thermal processing treatment (low-temperature two-phase region treatment) will be described. In the low-temperature two-phase region treatment, the toughness of a base metal is improved through tempering of martensite. Furthermore, in the low-temperature two-phase region treatment, since thermally stable and fine austenite is generated, and the austenite is stably present even at room temperature, fracture-resisting performance (particularly, the toughness and arrestability of the base metal, and the unstable fracture-suppressing characteristic of the welded joint) improve. When the heating temperature in the low-temperature two-phase region treatment is below 500° C. the, the toughness of the base metal degrades. In addition, when the heating temperature in the low-temperature two-phase region treatment exceeds 650° C., the strength of the base metal is not sufficient. Therefore, the heating temperature in the low-temperature two-phase region treatment is 500° C. to 650° C. Meanwhile, after the heating in the low-temperature two-phase region treatment, any cooling of air cooling and water cooling can be carried out. The cooling may be a combination of air cooling and water cooling. In addition, the water cooling refers to cooling at a cooling rate of more than 3° C./s at the ¼ t portion in a steel plate. The upper limit of the cooling rate of the water cooling is not particularly limited. In addition, the air cooling refers to cooling at a cooling rate of 3° C./s or less while the temperature at the ¼ t portion in the steel plate is from 800° C. to 500° C. In the air cooling, the cooling rate at higher than 800° C. and lower than 500° C. is not particularly limited. The lower limit of the cooling rate of the air cooling may be, for example, 0.01° C./s or more from the viewpoint of productivity.

As such, in the fourth thermal processing treatment, the slab after the third thermal processing treatment is heated to the above heating temperature and cooled.

Thus far, the first embodiment has been described.

In addition, hereinafter, the second embodiment of the method of manufacturing a Ni-added steel plate of the invention will be shown.

Second Embodiment

In the first thermal processing treatment (band segregation reduction treatment) in the second embodiment, the evenness of the solutes can be further enhanced, and fracture-resisting performance can be significantly improved by carrying out the hot rolling (the first hot rolling) subsequent to a thermal treatment (heating). Here, it becomes necessary to specify the heating temperature, the holding time, the rolling reduction in the hot rolling, and the rolling temperature of the hot rolling in the first thermal processing treatment (band segregation reduction treatment). Regarding the heating temperature and the holding time, as the temperature increases, and the holding time increases, the Ni segregation ratio decreases due to diffusion. The inventors investigated the influence of the combination of the heating temperature and the holding time in the first thermal processing treatment (band segregation reduction treatment) on the Ni segregation ratio. As a result, it was found that, in order to obtain a steel plate having a Ni segregation ratio at the ¼ t portion of 1.3 or less, it is necessary to hold a slab for 8 hours or more at a heating temperature of 1250° C. or higher. Therefore, in the first thermal processing treatment, the heating temperature is 1250° C. or higher, and the holding time is 8 hours or more. Meanwhile, when the heating temperature is set to 1380° C. or higher, and the holding time is set to 50 hours, productivity significantly degrades, and therefore the heating temperature is limited to 1380° C. or lower, and the holding time is limited to 50 hours or less. Meanwhile, when the heating temperature is set to 1300° C. or higher, and the holding time is set to 30 hours or more, the Ni segregation ratio further decreases. Therefore, the heating temperature is preferably 1300° C. or higher, and the holding time is preferably 30 hours or more. Meanwhile, the hot rolling may begin within the holding time.

In the first thermal processing treatment (band segregation reduction treatment) in the second embodiment, the segregation reduction effect can be expected during rolling and during air cooling after the rolling. That is, in a case in which recrystallization occurs, a segregation reduction effect is generated due to grain boundary migration, and, in a case in which recrystallization does not occur, a segregation reduction effect is generated due to diffusion at a high dislocation density. Therefore, the banded Ni segregation ratio decreases as the rolling reduction increases during the hot rolling. As a result of investigating the influence of the rolling reduction in the hot rolling on the segregation ratio, the inventors found that it is effective to set the rolling reduction to 1.2 or more in order to achieve a Ni segregation ratio of 1.3 or less. In addition, when the rolling reduction exceeds 40, productivity significantly degrades. Therefore, in the second embodiment, the rolling reduction of the hot rolling in the first thermal processing treatment (band segregation reduction treatment) is 1.2 to 40. In addition, when the rolling reduction is 2.0 or more, the segregation ratio further decreases, and therefore the rolling reduction is preferably 2.0 to 40. When it is considered that hot rolling is carried out in the second thermal processing treatment, the rolling reduction in the hot rolling in the first thermal processing treatment is more preferably 10 or less.

In the first thermal processing treatment (band segregation reduction treatment) in the second embodiment, it is also extremely important to control the temperature before the final pass in the hot rolling to an appropriate temperature. When the temperature before the final pass is too low, diffusion does not proceed during the air cooling after the rolling, and the Ni segregation ratio increases. Conversely, when the temperature before the final pass is too high, the dislocation density rapidly decreases due to recrystallization, the diffusion effect at a high dislocation density during the air cooling after the end of the rolling degrades, and the Ni segregation ratio increases. In the hot rolling in the first thermal processing treatment (band segregation reduction treatment) in the second embodiment, a temperature region in which dislocations appropriately remain in steel and diffusion easily proceeds is present. As a result of investigating the relationship between the temperature before the final pass in the hot rolling and the Ni segregation ratio, the inventors found that the Ni segregation ratio extremely increases at lower than 800° C. or higher than 1200° C. Therefore, in the second embodiment, the temperature before the final pass in the hot rolling in the first thermal processing treatment (band segregation reduction treatment) is 800° C. to 1200° C. Meanwhile, when the temperature before the final pass is 950° C. to 1150° C., the segregation ratio reduction effect is further enhanced, and therefore the temperature before the final pass in the hot rolling in the first thermal processing treatment (band segregation reduction treatment) is preferably 950° C. to 1150° C. After the hot rolling, air cooling is carried out. The diffusion of substitution-type solutes further proceeds through the air cooling after the rolling, and segregation decreases. Meanwhile, when the temperature at which the process moves from the air cooling after the rolling to the second thermal processing treatment (tempering treatment) exceeds 300° C., transformation is not completed, and material qualities become uneven. Therefore, the surface temperature (air cooling-end temperature) of a slab at a point in time at which the process moves from the air cooling after rolling to the second thermal processing treatment (tempering treatment) is 300° C. or lower. The lower limit of the air cooling-end temperature is not particularly limited. For example, the lower limit of the air cooling-end temperature may be room temperature, or may be −40° C. Meanwhile, the heating temperature refers to the temperature of the surface of a slab, and the holding time refers to a held time after the surface of the slab reaches the set heating temperature, and 3 hours elapses. The rolling reduction refers to a value obtained by subtracting the plate thickness after the rolling from the plate thickness before the rolling. In the second embodiment, the rolling reduction is computed with respect to the hot rolling in each of the thermal processing treatments. In addition, the temperature before the final pass refers to the temperature of the surface of a slab measured immediately before engagement (engagement of the slab into a rolling roll) of the final pass of the rolling, and can be measured using a thermometer such as a radiation thermometer. The air cooling refers to cooling at a cooling rate of 3° C./s or less while the temperature at the ¼ t portion in the steel plate is from 800° C. to 500° C. In the air cooling, the cooling rate at higher than 800° C. and lower than 500° C. is not particularly limited. The lower limit of the cooling rate of the air cooling may be, for example, 0.01° C./s or more from the viewpoint of productivity.

After the first thermal processing treatment (band segregation reduction treatment), similarly to the first embodiment, the second thermal processing treatment (hot rolling and a controlled cooling treatment), the third thermal processing treatment (high-temperature two-phase region treatment), and the fourth thermal processing treatment (low-temperature two-phase region treatment) are carried out. Therefore, the second thermal processing treatment (hot rolling and a controlled cooling treatment), the third thermal processing treatment (high-temperature two-phase region treatment), and the fourth thermal processing treatment (low-temperature two-phase region treatment) will not be described.

In addition, hereinafter, a modified embodiment of the first embodiment and a modified embodiment of the second embodiment of the method of manufacturing a Ni-added steel plate according to the invention will be described.

Modified Embodiment of the First Embodiment and a Modified Embodiment of the Second Embodiment In the modified embodiment of the first embodiment and the modified embodiment of the second embodiment, reheating after cooling is carried out between the hot rolling and the controlled cooling in the second thermal processing treatment (hot rolling and a controlled cooling treatment). That is, the slab is hot-rolled, cooled using air, and then reheated. When the reheating temperature exceeds 900° C., the grain diameter of austenite increases such that the toughness of the base metal degrades. In addition, when the reheating temperature is lower than 780° C., it is difficult to secure hardenability, and therefore strength decreases. Therefore, the reheating temperature in the reheating after cooling needs to be 780° C. to 900° C.

Meanwhile, in order to generate a tempered microstructure so as to sufficiently secure the strength of the base metal, controlled cooling is carried out rapidly after the reheating after cooling is carried out. In a case in which the controlled cooling is carried out through water cooling, the cooling preferably ends at 200° C. or lower. The lower limit of the water cooling-end temperature is not particularly limited.

In the modified embodiment, similarly to the first embodiment and the second embodiment, the first thermal processing treatment (band segregation reduction treatment), the second thermal processing treatment (hot rolling and a controlled cooling treatment) including the reheating after cooling, the third thermal processing treatment (high-temperature two-phase region treatment), and the fourth thermal processing treatment (low-temperature two-phase region treatment) are carried out. Therefore, the first thermal processing treatment (band segregation reduction treatment), the third thermal processing treatment (high-temperature two-phase region treatment), and the fourth thermal processing treatment (low-temperature two-phase region treatment) will not be described.

Steel plates manufactured in the first embodiment, the second embodiment, and the modified embodiment are excellent in fracture-resisting performance at approximately −160° C., and can be generally used for welded structures such as ships, bridges, constructions, marine structures, pressure vessels, tanks, and line pipes. Particularly, the steel plate manufactured using the manufacturing method is effective for use in an LNG tank which demands fracture-resisting performance at an extremely low temperature of approximately −160° C.

Figure 4:
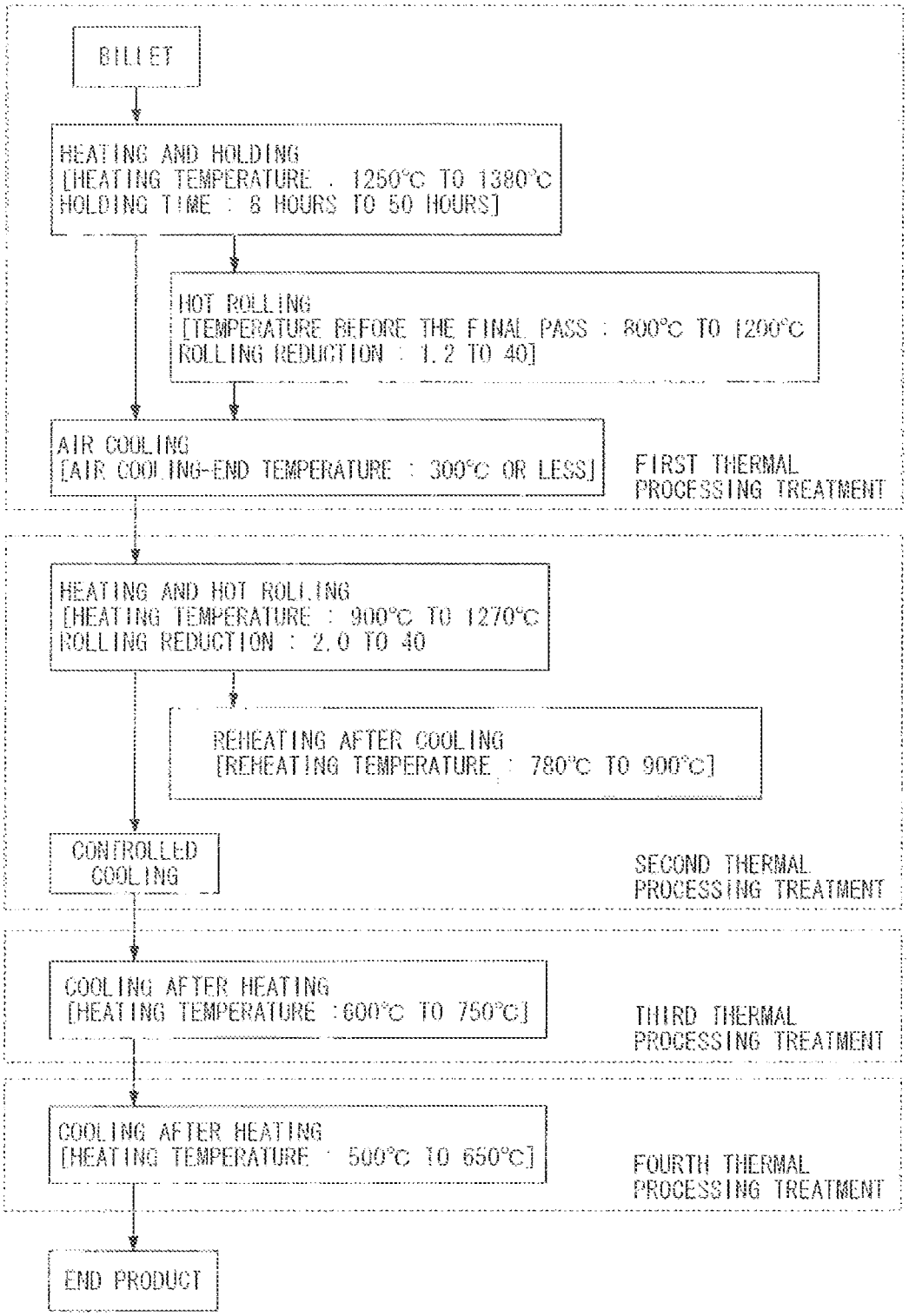
FIG. 4 is a view showing a flow chart of a method of manufacturing a Ni-added steel plate according to respective embodiments of the invention.

Meanwhile, the Ni-added steel plate of the invention can be preferably manufactured using the above embodiments as schematically shown in FIG. 4, but the embodiments simply show an example of the method of manufacturing a Ni-added steel plate of the invention. For example, the method of manufacturing a Ni-added steel plate of the invention is not particularly limited as long as the Ni segregation ratio, the fraction of austenite after deep cooling, the average equivalent circle diameter, and the austenite unevenness index after deep cooling can be controlled in the above appropriate ranges.

EXAMPLES

The following evaluations were carried out on steel plates having a plate thickness of 6 mm to 50 mm which were manufactured using various chemical components and manufacturing conditions. The yield stress and tensile strength of the base metal were evaluated through tensile tests, and the CTOD values of a base metal and a welded joint were obtained through CTOD tests, thereby evaluating the toughness of the base metal and the welded joint. In addition, the cracking entry distance in the base metal and the welded joint were obtained through duplex ESSO tests, thereby evaluating the arrestability of the base metal and the welded joint. Furthermore, the unstable fracture-suppressing characteristic of the welded joint was evaluated by confirming whether or not unstable ductile fracture occurred from stopped brittle cracking in the duplex ESSO test of the welded joint. The chemical components of the steel plates are shown in Table 1. In addition, the plate thickness of the steel plates, the Ni segregation ratios, the fractions of austenite after deep cooling, and minimum fraction of austenite after deep cooling are shown in Table 2. Furthermore, the methods of manufacturing the steel plates are shown in Table 3, and the evaluation results of the fracture-resisting performance of the base metal and the welded joint are shown in Table 4. Meanwhile, in the first thermal processing treatment, the slab was cooled using air to 300° C. or lower before the second thermal processing treatment.

TABLE 1

| | mass % | | | | | | | | | | | | |
|---|---|---|---|---|---|---|---|---|---|---|---|---|---|
| | C | Si | Mn | P | S | Ni | Cr | Mo | V | Al | N | T—O | Others |
| EXAMPLE1 | 0.06 | 0.06 | 0.32 | 0.0021 | 0.0002 | 6.3 | 0.44 | 0.29 | | 0.048 | 0.0054 | 0.0029 | |
| COMPARATIVE EXAMPLE1 | 0.11 | 0.07 | 0.34 | 0.0022 | 0.0002 | 6.3 | 0.45 | 0.28 | | 0.047 | 0.0056 | 0.0030 | |
| EXAMPLE2 | 0.10 | 0.35 | 0.33 | 0.0069 | 0.0010 | 6.8 | 1.17 | 0.02 | | 0.063 | 0.0043 | 0.0028 | |
| COMPARATIVE EXAMPLE2 | 0.09 | 0.41 | 0.33 | 0.0072 | 0.0011 | 6.9 | 1.14 | 0.03 | | 0.066 | 0.0045 | 0.0027 | |
| EXAMPLE3 | 0.04 | 0.06 | 0.86 | 0.0053 | 0.0030 | 6.3 | 0.70 | 0.12 | | 0.025 | 0.0003 | 0.0006 | |
| COMPARATIVE EXAMPLE3 | 0.04 | 0.05 | 1.21 | 0.0053 | 0.0031 | 6.3 | 0.66 | 0.11 | | 0.027 | 0.0003 | 0.0007 | |
| EXAMPLE4 | 0.07 | 0.15 | 0.74 | 0.0059 | 0.0008 | 7.4 | 0.58 | 0.21 | | 0.075 | 0.0051 | 0.0036 | |
| COMPARATIVE EXAMPLE4 | 0.07 | 0.16 | 0.76 | 0.0115 | 0.0008 | 7.4 | 0.53 | 0.22 | | 0.074 | 0.0047 | 0.0036 | |
| EXAMPLE5 | 0.08 | 0.05 | 1.08 | 0.0044 | 0.0003 | 6.6 | 1.30 | 0.03 | | 0.033 | 0.0018 | 0.0014 | |
| COMPARATIVE EXAMPLE5 | 0.09 | 0.05 | 1.02 | 0.0041 | 0.0036 | 6.4 | 1.34 | 0.03 | | 0.032 | 0.0018 | 0.0014 | |
| EXAMPLE6 | 0.04 | 0.05 | 0.66 | 0.0043 | 0.0026 | 6.1 | 0.85 | 0.14 | | 0.048 | 0.0026 | 0.0011 | |
| COMPARATIVE EXAMPLE6 | 0.04 | 0.05 | 0.72 | 0.0046 | 0.0028 | 4.9 | 0.88 | 0.16 | | 0.048 | 0.0027 | 0.0010 | |
| EXAMPLE7 | 0.08 | 0.14 | 0.32 | 0.0048 | 0.0025 | 7.2 | 1.25 | 0.03 | | 0.014 | 0.0037 | 0.0020 | |

TABLE 1-continued

| | mass % | | | | | | | | | | | | |
|---|---|---|---|---|---|---|---|---|---|---|---|---|---|
| | C | Si | Mn | P | S | Ni | Cr | Mo | V | Al | N | T—O | Others |
| COMPARATIVE EXAMPLE7 | 0.08 | 0.14 | 0.31 | 0.0047 | 0.0025 | 7.3 | 1.69 | 0.03 | | 0.015 | 0.0039 | 0.0019 | |
| EXAMPLE8 | 0.05 | 0.29 | 0.33 | 0.0092 | 0.0030 | 6.6 | 1.39 | 0.34 | | 0.050 | 0.0049 | 0.0030 | |
| COMPARATIVE EXAMPLE8 | 0.05 | 0.28 | 0.35 | 0.0097 | 0.0033 | 6.5 | 1.43 | 0.46 | | 0.053 | 0.0052 | 0.0029 | |
| EXAMPLE9 | 0.05 | 0.05 | 0.84 | 0.0029 | 0.0009 | 6.5 | 0.46 | 0.20 | | 0.040 | 0.0040 | 0.0009 | |
| COMPARATIVE EXAMPLE9 | 0.06 | 0.05 | 0.82 | 0.0047 | 0.0009 | 4.8 | 0.46 | 0.20 | | 0.030 | 0.0040 | 0.0023 | |
| EXAMPLE10 | 0.05 | 0.08 | 0.56 | 0.0013 | 0.0010 | 5.1 | 0.71 | 0.19 | | 0.043 | 0.0063 | 0.0010 | |
| COMPARATIVE EXAMPLE10 | 0.06 | 0.08 | 0.50 | 0.0013 | 0.0011 | 5.3 | 0.73 | 0.19 | | 0.081 | 0.0064 | 0.0010 | |
| EXAMPLE11 | 0.10 | 0.10 | 1.05 | 0.0042 | 0.0007 | 6.5 | 0.46 | 0.37 | | 0.041 | 0.0025 | 0.0009 | |
| COMPARATIVE EXAMPLE11 | 0.09 | 0.10 | 1.02 | 0.0044 | 0.0007 | 6.5 | 0.47 | 0.40 | | 0.046 | 0.0071 | 0.0009 | |
| EXAMPLE12 | 0.07 | 0.21 | 0.51 | 0.0010 | 0.0011 | 7.2 | 0.46 | 0.15 | | 0.064 | 0.0007 | 0.0034 | |
| COMPARATIVE EXAMPLE12 | 0.07 | 0.20 | 0.51 | 0.0011 | 0.0012 | 7.3 | 0.43 | 0.15 | | 0.066 | 0.0008 | 0.0051 | |
| EXAMPLE13 | 0.05 | 0.04 | 0.45 | 0.0044 | 0.0001 | 5.7 | 0.66 | 0.12 | | 0.032 | 0.0006 | 0.0035 | 0.4Cu |
| COMPARATIVE EXAMPLE13 | 0.05 | 0.04 | 0.44 | 0.0045 | 0.0001 | 5.9 | 0.67 | 0.12 | | 0.031 | 0.0006 | 0.0035 | 0.4Cu |
| EXAMPLE14 | 0.08 | 0.11 | 0.70 | 0.0037 | 0.0002 | 6.8 | 0.55 | 0.18 | | 0.057 | 0.0047 | 0.0038 | |
| COMPARATIVE EXAMPLE14 | 0.09 | 0.11 | 0.71 | 0.0038 | 0.0002 | 6.9 | 0.58 | 0.18 | | 0.062 | 0.0047 | 0.0037 | |
| EXAMPLE15 | 0.08 | 0.36 | 1.06 | 0.0069 | 0.0028 | 6.7 | 0.42 | 0.03 | | 0.011 | 0.0045 | 0.0040 | 0.012Ti |
| COMPARATIVE EXAMPLE15 | 0.09 | 0.37 | 1.12 | 0.0068 | 0.0027 | 6.6 | 0.41 | 0.05 | | 0.012 | 0.0045 | 0.0037 | 0.012Ti |
| EXAMPLE16 | 0.05 | 0.05 | 0.83 | 0.0011 | 0.0009 | 7.3 | 1.11 | 0.27 | | 0.073 | 0.0050 | 0.0027 | |
| COMPARATIVE EXAMPLE16 | 0.05 | 0.05 | 0.87 | 0.0010 | 0.0009 | 7.5 | 1.19 | 0.26 | | 0.073 | 0.0047 | 0.0028 | |
| EXAMPLE17 | 0.04 | 0.08 | 0.57 | 0.0041 | 0.0011 | 5.7 | 0.78 | 0.17 | | 0.013 | 0.0037 | 0.0011 | 0.008Nb |
| COMPARATIVE EXAMPLE17 | 0.05 | 0.08 | 0.54 | 0.0041 | 0.0011 | 6.0 | 0.79 | 0.17 | | 0.013 | 0.0039 | 0.0011 | 0.008Nb |
| EXAMPLE18 | 0.07 | 0.03 | 0.65 | 0.0072 | 0.0026 | 5.7 | 0.95 | 0.08 | | 0.040 | 0.0012 | 0.0034 | |
| COMPARATIVE EXAMPLE18 | 0.12 | 0.03 | 0.73 | 0.0074 | 0.0025 | 5.9 | 0.99 | 0.08 | | 0.038 | 0.0013 | 0.0033 | |
| EXAMPLE19 | 0.05 | 0.13 | 0.61 | 0.0044 | 0.0019 | 7.0 | 1.48 | 0.03 | 0.015 | 0.074 | 0.0056 | 0.0033 | 0.015V 0.002REN |
| COMPARATIVE EXAMPLE19 | 0.05 | 0.13 | 0.64 | 0.0046 | 0.0020 | 7.0 | 1.41 | 0.04 | 0.015 | 0.070 | 0.0055 | 0.0033 | 0.015V 0.002REN |
| EXAMPLE20 | 0.05 | 0.21 | 0.97 | 0.0088 | 0.0021 | 6.6 | 1.12 | 0.15 | | 0.039 | 0.0040 | 0.0001 | |
| COMPARATIVE EXAMPLE20 | 0.05 | 0.20 | 1.02 | 0.0089 | 0.0021 | 4.9 | 1.16 | 0.16 | | 0.041 | 0.0041 | 0.0001 | |
| EXAMPLE21 | 0.06 | 0.35 | 1.07 | 0.0094 | 0.0008 | 5.6 | 0.89 | 0.22 | | 0.073 | 0.0045 | 0.0030 | 0.001B |
| COMPARATIVE EXAMPLE21 | 0.06 | 0.35 | 1.09 | 0.0092 | 0.0008 | 5.7 | 0.90 | 0.22 | | 0.073 | 0.0048 | 0.0032 | 0.001B |
| EXAMPLE22 | 0.09 | 0.05 | 0.42 | 0.0035 | 0.0005 | 7.4 | 0.78 | 0.07 | | 0.043 | 0.0002 | 0.0034 | 0.0023Ca |
| COMPARATIVE EXAMPLE22 | 0.09 | 0.05 | 0.47 | 0.0036 | 0.0005 | 7.4 | 0.80 | 0.06 | | 0.042 | 0.0002 | 0.0037 | 0.0021Ca |
| EXAMPLE23 | 0.05 | 0.12 | 1.03 | 0.0076 | 0.0027 | 5.7 | 0.47 | 0.13 | | 0.055 | 0.0029 | 0.0033 | |
| COMPARATIVE EXAMPLE23 | 0.05 | 0.12 | 1.01 | 0.0077 | 0.0027 | 5.7 | 0.46 | 0.13 | | 0.054 | 0.0031 | 0.0031 | 0.0030Mg |
| EXAMPLE24 | 0.05 | 0.04 | 0.70 | 0.0048 | 0.0001 | 6.5 | 0.59 | 0.04 | | 0.068 | 0.0067 | 0.0018 | 0.0030Mg |
| COMPARATIVE EXAMPLE24 | 0.04 | 0.04 | 0.69 | 0.0051 | 0.0001 | 6.6 | 0.53 | 0.04 | | 0.074 | 0.0068 | 0.0018 | |
| EXAMPLE25 | 0.05 | 0.06 | 0.94 | 0.0012 | 0.0007 | 6.2 | 0.61 | 0.02 | | 0.032 | 0.0028 | 0.0008 | |
| COMPARATIVE EXAMPLE25 | 0.05 | 0.06 | 0.91 | 0.0057 | 0.0009 | 6.6 | 0.66 | 0.02 | | 0.038 | 0.0038 | 0.0014 | |
| EXAMPLE26 | 0.06 | 0.22 | 0.84 | 0.0061 | 0.0004 | 7.3 | 1.29 | 0.13 | | 0.020 | 0.0037 | 0.0009 | |
| COMPARATIVE EXAMPLE26 | 0.06 | 0.23 | 0.80 | 0.0063 | 0.0004 | 7.4 | 1.25 | 0.13 | | 0.021 | 0.0038 | 0.0009 | |

TABLE 2

| | THICKNESS OF THE CAST SLAB mm | THICKNESS OF THE MIDDLE SLAB mm | SHEET THICKNESS mm | Ni SEGREGATION RATIO — | FRACTION OF γ AFTER DEEP COOLING % | AVERAGE EQUIVALENT CIRCLE DIAMETER OF γ AFTER DEEP COOLING μm | γ UNEVENNESS INDEX AFTER DEEP COOLING — |
|---|---|---|---|---|---|---|---|
| EXAMPLE1 | 550 | 60 | 6 | 1.10 | 8.4 | 0.2 | 2.6 |
| COMPARATIVE EXAMPLE1 | 550 | 60 | 6 | 1.11 | 8.4 | 0.5 | 2.6 |
| EXAMPLE2 | 550 | 63 | 12 | 1.29 | 5.9 | 0.3 | 4.1 |
| COMPARATIVE EXAMPLE2 | 550 | 63 | 12 | 1.29 | 6.0 | 0.3 | 4.1 |
| EXAMPLE3 | 450 | 450 | 20 | 1.16 | 4.6 | 0.2 | 4.5 |
| COMPARATIVE EXAMPLE3 | 450 | 450 | 20 | 1.16 | 4.7 | 0.2 | 4.6 |
| EXAMPLE4 | 320 | 120 | 34 | 1.05 | 5.9 | 0.1 | 3.3 |
| COMPARATIVE EXAMPLE4 | 180 | 120 | 34 | 1.06 | 6.0 | 0.3 | 3.3 |
| EXAMPLE5 | 250 | 200 | 40 | 1.13 | 3.3 | 0.6 | 4.4 |
| COMPARATIVE EXMAPLE5 | 250 | 200 | 40 | 1.14 | 3.3 | 0.6 | 4.5 |
| EXAMPLE6 | 200 | 111 | 6 | 1.29 | 7.7 | 0.3 | 3.0 |
| COMPARATIVE EXAMPLE6 | 200 | 125 | 6 | 1.28 | 7.9 | 1.5 | 3.0 |
| EXAMPLE7 | 650 | 70 | 12 | 1.12 | 7.1 | 0.1 | 2.6 |
| COMPARATIVE EXAMPLE7 | 650 | 70 | 12 | 1.12 | 7.1 | 1.2 | 2.6 |
| EXAMPLE8 | 550 | 71 | 20 | 1.07 | 6.9 | 0.5 | 3.3 |
| COMPARATIVE EXAMPLE8 | 550 | 63 | 20 | 1.04 | 2.3 | 0.3 | 3.3 |
| EXAMPLE9 | 320 | 160 | 32 | 1.03 | 8.1 | 0.3 | 4.0 |
| COMPARATIVE EXAMPLE9 | 320 | 160 | 32 | 1.01 | 8.1 | 0.1 | 3.9 |
| EXAMPLE10 | 450 | 450 | 32 | 1.14 | 8.4 | 0.3 | 3.6 |
| COMPARATIVE EXAMPLE10 | 450 | 450 | 32 | 1.14 | 8.6 | 0.2 | 3.5 |
| EXAMPLE11 | 320 | 260 | 50 | 1.26 | 3.0 | 0.3 | 4.9 |

TABLE 2-continued

| | THICKNESS OF THE CAST SLAB mm | THICKNESS OF THE MIDDLE SLAB mm | SHEET THICKNESS mm | Ni SEGREGATION RATIO — | FRACTION OF γ AFTER DEEP COOLING % | AVERAGE EQUIVALENT CIRCLE DIAMETER OF γ AFTER DEEP COOLING μm | γ UNEVENNESS INDEX AFTER DEEP COOLING — |
|---|---|---|---|---|---|---|---|
| COMPARATIVE EXAMPLE11 | 320 | 260 | 50 | 1.26 | 3.1 | 0.5 | 4.9 |
| EXAMPLE12 | 250 | 161 | 6 | 1.28 | 2.1 | 0.3 | 3.0 |
| COMPARATIVE EXAMPLE12 | 250 | 125 | 6 | 1.28 | 2.2 | 0.3 | 3.0 |
| EXAMPLE13 | 200 | 160 | 25 | 1.27 | 4.0 | 0.2 | 3.0 |
| COMPARATIVE EXAMPLE13 | 200 | 160 | 25 | 1.32 | 4.2 | 0.9 | 5.1 |
| EXAMPLE14 | 650 | 200 | 20 | 1.10 | 4.1 | 0.5 | 3.4 |
| COMPARATIVE EXAMPLE14 | 650 | 280 | 20 | 1.40 | 4.2 | 0.2 | 5.5 |
| EXAMPLE15 | 550 | 200 | 32 | 1.08 | 10.0 | 0.2 | 4.2 |
| COMPARATIVE EXAMPLE15 | 550 | 200 | 32 | 1.41 | 10.3 | 1.3 | 5.5 |
| EXAMPLE16 | 450 | 200 | 50 | 1.11 | 4.5 | 0.2 | 3.5 |
| COMPARATIVE EXAMPLE16 | 450 | 90 | 50 | 1.33 | 1.5 | 0.4 | 5.3 |
| EXAMPLE17 | 320 | 200 | 6 | 1.24 | 4.2 | 0.3 | 4.8 |
| COMPARATIVE EXAMPLE17 | 320 | 200 | 6 | 1.22 | 1.3 | 1.2 | 4.7 |
| EXAMPLE18 | 250 | 200 | 12 | 1.13 | 2.8 | 0.3 | 2.7 |
| COMPARATIVE EXAMPLE18 | 250 | 200 | 12 | 1.14 | 2.9 | 0.3 | 2.6 |
| EXAMPLE19 | 200 | 120 | 22 | 1.29 | 5.7 | 0.3 | 3.0 |
| COMPARATIVE EXAMPLE19 | 200 | 120 | 22 | 1.28 | 5.8 | 1.2 | 3.0 |
| EXAMPLE20 | 650 | 70 | 32 | 1.07 | 2.3 | 0.3 | 3.4 |
| COMPARATIVE EXAMPLE20 | 650 | 70 | 32 | 1.05 | 2.3 | 1.6 | 3.3 |
| EXAMPLE21 | 550 | 550 | 50 | 1.14 | 8.9 | 0.2 | 4.5 |
| COMPARATIVE EXAMPLE21 | 550 | 550 | 50 | 1.18 | 1.9 | 0.2 | 4.6 |
| EXAMPLE22 | 450 | 125 | 6 | 1.18 | 2.0 | 0.3 | 3.7 |
| COMPARATIVE EXAMPLE22 | 450 | 125 | 6 | 1.17 | 1.6 | 0.3 | 3.6 |
| EXAMPLE23 | 320 | 63 | 12 | 1.14 | 3.5 | 0.2 | 4.4 |
| COMPARATIVE EXAMPLE23 | 320 | 45 | 12 | 1.10 | 0.9 | 0.7 | 4.3 |
| EXAMPLE24 | 250 | 250 | 20 | 1.22 | 4.9 | 0.9 | 2.9 |
| COMPARATIVE EXAMPLE24 | 250 | 250 | 20 | 1.26 | 5.0 | 1.5 | 2.9 |
| EXAMPLE25 | 250 | 80 | 6 | 0.99 | 4.5 | 0.2 | 3.9 |
| COMPARATIVE EXAMPLE25 | 250 | 80 | 6 | 1.38 | 4.5 | 1.2 | 5.4 |
| EXAMPLE26 | 200 | 150 | 32 | 1.24 | 2.4 | 0.1 | 2.9 |
| COMPARATIVE EXAMPLE26 | 200 | 190 | 32 | 1.34 | 2.5 | 1.1 | 5.6 |

TABLE 3

| | (1) | | | | (6) | | | | | (9) | | (10) | |
|---|---|---|---|---|---|---|---|---|---|---|---|---|---|
| | (2) ° C. | (3) hr | (4) — | (5) ° C. | (2) ° C. | (4) — | (5) ° C. | (7)*1 ° C. | (8) ° C. | (2) ° C. | (7)*1 ° C. | (2) ° C. | (7)*1 ° C. |
| EXAMPLE1 | 1335 | 24 | 9.2 | 854 | 1218 | 10.0 | 772 | 192 | — | 722 | 154 | 618 | 120 |
| COMPARATIVE EXAMPLE1 | 1378 | 24 | 9.2 | 850 | 1218 | 10.0 | 786 | 196 | — | 724 | 134 | 620 | 101 |
| EXAMPLE2 | 1269 | 23 | 8.8 | 932 | 965 | 5.2 | 735 | 117 | — | 616 | 123 | 637 | 98 |
| COMPARATIVE EXAMPLE2 | 1297 | 23 | 8.8 | 929 | 984 | 5.2 | 745 | 117 | — | 618 | 117 | 641 | 105 |
| EXAMPLE3 | 1349 | 41 | — | — | 1000 | 22.5 | 729 | 150 | — | 676 | 131 | 623 | 130 |
| COMPARATIVE EXAMPLE3 | 1360 | 41 | — | — | 1021 | 22.5 | 730 | 154 | — | 671 | 101 | 628 | 96 |
| EXAMPLE4 | 1362 | 38 | 2.7 | 1131 | 918 | 3.5 | 745 | 56 | — | 727 | 76 | 591 | 82 |
| COMPARATIVE EXAMPLE4 | 1362 | 39 | 1.5 | 1148 | 922 | 3.5 | 750 | 65 | — | 727 | 68 | 609 | 108 |
| EXAMPLE5 | 1301 | 28 | 1.3 | 1127 | 1098 | 5.0 | 805 | 175 | — | 725 | 155 | 628 | 164 |
| COMPARATIVE EXMAPLE5 | 1297 | 28 | 1.3 | 1145 | 1123 | 5.0 | 811 | 175 | — | 743 | 138 | 626 | 155 |
| EXAMPLE6 | 1301 | 35 | 1.8 | 887 | 970 | 18.5 | 813 | — | 866 | 634 | — | 656 | — |
| COMPARATIVE EXAMPLE6 | 1287 | 35 | 1.6 | 901 | 992 | 20.8 | 819 | — | 910 | 645 | — | 655 | — |
| EXAMPLE7 | 1339 | 17 | 9.3 | 1123 | 1219 | 5.8 | 759 | 125 | 790 | 632 | 101 | 507 | 97 |
| COMPARATIVE EXAMPLE7 | 1367 | 17 | 9.3 | 1126 | 1246 | 5.8 | 764 | 128 | 765 | 645 | 93 | 510 | 96 |
| EXAMPLE8 | 1379 | 39 | 7.7 | 1107 | 1236 | 3.6 | 823 | 84 | — | 647 | 78 | 612 | 79 |
| COMPARATIVE EXAMPLE8 | 1377 | 39 | 8.8 | 1124 | 1244 | 3.1 | 831 | 83 | — | 650 | 90 | 613 | 82 |
| EXAMPLE9 | 1360 | 36 | 2.0 | 1012 | 1113 | 5.0 | 825 | 102 | — | 684 | 96 | 592 | 101 |
| COMPARATIVE EXAMPLE9 | 1346 | 34 | 2.0 | 1010 | 1115 | 5.0 | 820 | 116 | — | 680 | 105 | 596 | 96 |
| EXAMPLE10 | 1349 | 46 | — | — | 1118 | 14.1 | 778 | 148 | — | 659 | 138 | 527 | 126 |
| COMPARATIVE EXAMPLE10 | 1379 | 47 | — | — | 1114 | 14.1 | 780 | 148 | — | 666 | 163 | 535 | 155 |
| EXAMPLE11 | 1290 | 10 | 1.23 | 1101 | 930 | 5.2 | 890 | 72 | — | 720 | 66 | 592 | 77 |
| COMPARATIVE EXAMPLE11 | 1314 | 10 | 1.23 | 1116 | 930 | 5.2 | 895 | 75 | — | 736 | 73 | 592 | 94 |
| EXAMPLE12 | 1302 | 10 | 1.6 | 1154 | 1194 | 26.9 | 825 | 65 | 898 | 715 | 89 | 585 | 72 |
| COMPARATIVE EXAMPLE12 | 1315 | 11 | 2.0 | 1170 | 1189 | 20.8 | 826 | 75 | 895 | 733 | 82 | 583 | 86 |
| EXAMPLE13 | 1314 | 39 | 1.3 | 929 | 1265 | 6.4 | 801 | 81 | — | 660 | 69 | 520 | 88 |
| COMPARATIVE EXAMPLE13 | 1249 | 41 | 1.3 | 941 | 1266 | 6.4 | 811 | 92 | — | 666 | 84 | 527 | 69 |
| EXAMPLE14 | 1301 | 29 | 3.3 | 1110 | 1116 | 10.0 | 749 | 81 | — | 618 | 73 | 533 | 84 |
| COMPARATIVE EXAMPLE14 | 1284 | 7 | 2.3 | 1122 | 1115 | 14.0 | 754 | 72 | — | 622 | 84 | 534 | 95 |
| EXAMPLE15 | 1372 | 45 | 2.8 | 870 | 1255 | 6.3 | 786 | 109 | — | 687 | 89 | 588 | 91 |
| COMPARATIVE EXAMPLE15 | 1277 | 9 | 2.8 | 1229 | 1268 | 6.3 | 797 | 79 | — | 695 | 88 | 596 | 98 |

TABLE 3-continued

| | (1) | | | | (6) | | | | | (9) | | (10) | |
|---|---|---|---|---|---|---|---|---|---|---|---|---|---|
| | (2) ° C. | (3) hr | (4) — | (5) ° C. | (2) ° C. | (4) — | (5) ° C. | (7)*1 ° C. | (8) ° C. | (2) ° C. | (7)*1 ° C. | (2) ° C. | (7)*1 ° C. |
| EXAMPLE16 | 1292 | 34 | 2.3 | 1174 | 1219 | 4.0 | 664 | 99 | — | 721 | 79 | 511 | 83 |
| COMPARATIVE EXAMPLE16 | 1287 | 12 | 5.0 | 795 | 1243 | 1.8 | 669 | 80 | — | 731 | 90 | 516 | 91 |
| EXAMPLE17 | 1311 | 39 | 1.6 | 899 | 1156 | 33.3 | 796 | — | — | 667 | 80 | 547 | 79 |
| COMPARATIVE EXAMPLE17 | 1313 | 39 | 1.6 | 912 | 1324 | 33.3 | 810 | — | — | 666 | 95 | 553 | 84 |
| EXAMPLE18 | 1347 | 24 | 1.3 | 1024 | 1191 | 16.7 | 863 | 125 | 820 | 621 | 107 | 616 | 104 |
| COMPARATIVE EXAMPLE18 | 1376 | 24 | 1.3 | 1032 | 881 | 16.7 | 876 | 125 | 820 | 624 | 119 | 633 | 116 |
| EXAMPLE19 | 1255 | 9 | 1.7 | 944 | 1195 | 5.5 | 761 | 79 | — | 703 | 101 | 635 | 98 |
| COMPARATIVE EXAMPLE19 | 1318 | 9 | 1.7 | 956 | 1207 | 5.5 | 915 | 77 | — | 717 | 129 | 639 | 79 |
| EXAMPLE20 | 1340 | 30 | 9.3 | 916 | 1257 | 2.2 | 868 | 157 | — | 621 | 128 | 541 | 92 |
| COMPARATIVE EXAMPLE20 | 1324 | 30 | 9.3 | 928 | 1264 | 2.2 | 650 | 159 | — | 627 | 99 | 540 | 108 |
| EXAMPLE21 | 1317 | 35 | — | — | 1018 | 11.0 | 668 | 75 | — | 612 | 88 | 649 | 85 |
| COMPARATIVE EXAMPLE21 | 1340 | 7 | — | — | 1012 | 11.0 | 674 | 236 | — | 616 | 79 | 656 | 92 |
| EXAMPLE22 | 1372 | 23 | 3.6 | 903 | 1147 | 20.8 | 878 | 155 | — | 752 | 96 | 634 | 104 |
| COMPARATIVE EXAMPLE22 | 1361 | 24 | 3.6 | 916 | 1280 | 20.8 | 886 | 156 | — | 599 | 82 | 480 | 116 |
| EXAMPLE23 | 1295 | 45 | 5.1 | 937 | 941 | 5.2 | 782 | 115 | — | 674 | 69 | 568 | 107 |
| COMPARATIVE EXAMPLE23 | 1275 | 46 | 7.1 | 934 | 964 | 3.8 | 788 | 116 | — | 762 | 87 | 578 | 111 |
| EXAMPLE24 | 1341 | 20 | — | — | 1215 | 12.5 | 736 | 86 | — | 640 | 95 | 648 | 78 |
| COMPARATIVE EXAMPLE24 | 1344 | 20 | — | — | 1259 | 12.5 | 745 | 75 | — | 647 | 76 | 497 | 69 |
| EXAMPLE25 | 1332 | 45 | 3.1 | 996 | 1167 | 13.3 | 820 | 95 | — | 688 | 99 | 584 | 89 |
| COMPARATIVE EXAMPLE25 | 1245 | 46 | 3.1 | 922 | 1189 | 13.3 | 820 | 92 | — | 687 | 103 | 588 | 94 |
| EXAMPLE26 | 1299 | 9 | 1.3 | 840 | 1003 | 4.7 | 876 | 85 | — | 665 | 93 | 622 | 78 |
| COMPARATIVE EXAMPLE26 | 1300 | 9 | 1.1 | 861 | 984 | 5.9 | 892 | 79 | — | 658 | 78 | 665 | 69 |

*1SIGN "—" REFERS THAT AIR COOLING HAS BEEN MADE AS CONTROLLED COOLING
(1) FIRST THERMAL PROCESSING TREATMENT (BAND SEGREGATION REDUCTION TREATMENT)
(2) HEATING TEMPERATURE
(3) HOLDING TIME
(4) ROLLING REDUCTION
(5) TEMPERATURE BEFORE THE FINAL PASS
(6) SECOND THERMAL PROCESSING TREATMENT (HOT ROLLING AND A CONTROLLED COOLING TREATMENT)
(7) WATER COOLING—END TEMPERATURE
(8) REHEATING TEMPERATURE
(9) THIRD THERMAL PROCESSING TREATMENT (TWO-PHASE REGION THERMAL TREATMENT)
(10) FOURTH THERMAL PROCESSING TREATMENT (ANNEALING TREATMENT)

TABLE 4

| | YIELD STRESS | TENSILE STRENGTH | CTOD VALUES OF A PARENT MATERIAL | | DUPLEX ESSO OF A PARENT MATERIAL | | CTOD VALUES OF A WELDED JOINT | | DUPLEX ESSO OF A WELDED JOINT | | UNSTABLE DUCTILE FRACTURE-SUPPRESSING CHARACTERISTIC | |
|---|---|---|---|---|---|---|---|---|---|---|---|---|
| | MPa | MPa | mm | EVALUATION | J | EVALUATION | mm | EVALUATION | mm | EVALUATION | mm | EVALUATION |
| EXAMPLE1 | 729 | 807 | 0.45 | ACCEPTANCE | 3 | ACCEPTANCE | 0.38 | ACCEPTANCE | 5 | ACCEPTANCE | NON-EXISTENCE | ACCEPTANCE |
| COMPARATIVE EXAMPLE1 | 749 | 824 | 0.28 | REJECTION | 2 | ACCEPTANCE | 0.08 | REJECTION | 230 | REJECTION | NON-EXISTENCE | ACCEPTANCE |
| EXAMPLE2 | 733 | 822 | 0.74 | ACCEPTANCE | 17 | ACCEPTANCE | 0.40 | ACCEPTANCE | 16 | ACCEPTANCE | NON-EXISTENCE | ACCEPTANCE |
| COMPARATIVE EXAMPLE2 | 738 | 826 | 0.25 | REJECTION | 22 | ACCEPTANCE | 0.21 | REJECTION | 23 | ACCEPTANCE | NON-EXISTENCE | ACCEPTANCE |
| EXAMPLE3 | 665 | 775 | 0.44 | ACCEPTANCE | 37 | ACCEPTANCE | 0.33 | ACCEPTANCE | 39 | ACCEPTANCE | NON-EXISTENCE | ACCEPTANCE |
| COMPARATIVE EXAMPLE3 | 686 | 796 | 0.24 | REJECTION | 21 | ACCEPTANCE | 0.13 | REJECTION | 39 | ACCEPTANCE | NON-EXISTENCE | ACCEPTANCE |
| EXAMPLE4 | 651 | 798 | 0.75 | ACCEPTANCE | 46 | ACCEPTANCE | 0.43 | ACCEPTANCE | 66 | ACCEPTANCE | NON-EXISTENCE | ACCEPTANCE |
| COMPARATIVE EXAMPLE4 | 651 | 799 | 0.29 | REJECTION | 56 | ACCEPTANCE | 0.23 | REJECTION | 33 | ACCEPTANCE | NON-EXISTENCE | ACCEPTANCE |
| EXAMPLE5 | 578 | 790 | 0.83 | ACCEPTANCE | 78 | ACCEPTANCE | 0.75 | ACCEPTANCE | 75 | ACCEPTANCE | NON-EXISTENCE | ACCEPTANCE |
| COMPARATIVE EXMAPLE5 | 582 | 795 | 0.21 | REJECTION | 149 | REJECTION | 0.08 | REJECTION | 53 | ACCEPTANCE | NON-EXISTENCE | ACCEPTANCE |
| EXAMPLE6 | 754 | 828 | 0.54 | ACCEPTANCE | 8 | ACCEPTANCE | 0.52 | ACCEPTANCE | 7 | ACCEPTANCE | NON-EXISTENCE | ACCEPTANCE |
| COMPARATIVE EXAMPLE6 | 746 | 822 | 0.19 | REJECTION | 27 | REJECTION | 0.05 | REJECTION | 307 | REJECTION | EXISTENCE | REJECTION |
| EXAMPLE7 | 716 | 807 | 0.46 | ACCEPTANCE | 23 | ACCEPTANCE | 0.34 | ACCEPTANCE | 13 | ACCEPTANCE | NON-EXISTENCE | ACCEPTANCE |
| COMPARATIVE EXAMPLE7 | 729 | 818 | 0.29 | REJECTION | 51 | REJECTION | 0.18 | REJECTION | 150 | REJECTION | EXISTENCE | REJECTION |
| EXAMPLE8 | 718 | 828 | 0.96 | ACCEPTANCE | 38 | ACCEPTANCE | 0.75 | ACCEPTANCE | 34 | ACCEPTANCE | NON-EXISTENCE | ACCEPTANCE |
| COMPARATIVE EXAMPLE8 | 749 | 858 | 0.66 | ACCEPTANCE | 21 | ACCEPTANCE | 0.23 | REJECTION | 222 | REJECTION | NON-EXISTENCE | ACCEPTANCE |
| EXAMPLE9 | 678 | 788 | 0.90 | ACCEPTANCE | 19 | ACCEPTANCE | 0.59 | ACCEPTANCE | 18 | ACCEPTANCE | NON-EXISTENCE | ACCEPTANCE |
| COMPARATIVE EXAMPLE9 | 662 | 773 | 0.25 | REJECTION | 123 | REJECTION | 0.06 | REJECTION | 306 | REJECTION | NON-EXISTENCE | ACCEPTANCE |
| EXAMPLE10 | 591 | 732 | 0.68 | ACCEPTANCE | 62 | ACCEPTANCE | 0.35 | ACCEPTANCE | 62 | ACCEPTANCE | NON-EXISTENCE | ACCEPTANCE |
| COMPARATIVE EXAMPLE10 | 595 | 736 | 0.51 | ACCEPTANCE | 46 | ACCEPTANCE | 0.06 | REJECTION | 227 | REJECTION | NON-EXISTENCE | ACCEPTANCE |
| EXAMPLE11 | 592 | 809 | 0.43 | ACCEPTANCE | 40 | ACCEPTANCE | 0.32 | ACCEPTANCE | 94 | ACCEPTANCE | NON-EXISTENCE | ACCEPTANCE |
| COMPARATIVE EXAMPLE11 | 604 | 824 | 0.18 | REJECTION | 230 | REJECTION | 0.11 | REJECTION | 315 | REJECTION | NON-EXISTENCE | ACCEPTANCE |
| EXAMPLE12 | 756 | 830 | 0.46 | ACCEPTANCE | 6 | ACCEPTANCE | 0.39 | ACCEPTANCE | 8 | ACCEPTANCE | NON-EXISTENCE | ACCEPTANCE |
| COMPARATIVE EXAMPLE12 | 756 | 830 | 0.22 | REJECTION | 22 | REJECTION | 0.28 | REJECTION | 29 | REJECTION | NON-EXISTENCE | ACCEPTANCE |
| EXAMPLE13 | 686 | 780 | 0.39 | ACCEPTANCE | 19 | ACCEPTANCE | 0.46 | ACCEPTANCE | 32 | ACCEPTANCE | NON-EXISTENCE | ACCEPTANCE |
| COMPARATIVE EXAMPLE13 | 688 | 782 | 0.69 | ACCEPTANCE | 42 | ACCEPTANCE | 0.23 | REJECTION | 152 | REJECTION | EXISTENCE | REJECTION |
| EXAMPLE14 | 702 | 812 | 0.77 | ACCEPTANCE | 36 | ACCEPTANCE | 0.48 | ACCEPTANCE | 7 | ACCEPTANCE | NON-EXISTENCE | ACCEPTANCE |
| COMPARATIVE EXAMPLE14 | 707 | 817 | 0.39 | ACCEPTANCE | 19 | ACCEPTANCE | 0.23 | REJECTION | 132 | REJECTION | EXISTENCE | REJECTION |
| EXAMPLE15 | 620 | 764 | 0.98 | ACCEPTANCE | 62 | ACCEPTANCE | 0.80 | ACCEPTANCE | 10 | ACCEPTANCE | NON-EXISTENCE | ACCEPTANCE |
| COMPARATIVE EXAMPLE15 | 626 | 771 | 0.92 | ACCEPTANCE | 10 | ACCEPTANCE | 0.09 | REJECTION | 228 | REJECTION | EXISTENCE | REJECTION |
| EXAMPLE16 | 604 | 824 | 0.86 | ACCEPTANCE | 72 | ACCEPTANCE | 0.69 | ACCEPTANCE | 92 | ACCEPTANCE | NON-EXISTENCE | ACCEPTANCE |
| COMPARATIVE EXAMPLE16 | 610 | 832 | 0.57 | ACCEPTANCE | 84 | ACCEPTANCE | 0.23 | REJECTION | 191 | REJECTION | EXISTENCE | REJECTION |
| EXAMPLE17 | 734 | 812 | 0.46 | ACCEPTANCE | 0 | ACCEPTANCE | 0.55 | ACCEPTANCE | 7 | ACCEPTANCE | NON-EXISTENCE | ACCEPTANCE |
| COMPARATIVE EXAMPLE17 | 743 | 819 | 0.23 | REJECTION | 24 | REJECTION | 0.54 | ACCEPTANCE | 7 | ACCEPTANCE | EXISTENCE | REJECTION |
| EXAMPLE18 | 730 | 819 | 0.83 | ACCEPTANCE | 22 | ACCEPTANCE | 0.63 | ACCEPTANCE | 14 | ACCEPTANCE | NON-EXISTENCE | ACCEPTANCE |
| COMPARATIVE EXAMPLE18 | 788 | 856 | 0.45 | ACCEPTANCE | 44 | REJECTION | 0.09 | REJECTION | 155 | REJECTION | NON-EXISTENCE | ACCEPTANCE |
| EXAMPLE19 | 704 | 814 | 0.52 | ACCEPTANCE | 43 | ACCEPTANCE | 0.33 | ACCEPTANCE | 34 | ACCEPTANCE | NON-EXISTENCE | ACCEPTANCE |
| COMPARATIVE EXAMPLE19 | 708 | 818 | 0.25 | REJECTION | 89 | REJECTION | 0.36 | ACCEPTANCE | 32 | ACCEPTANCE | EXISTENCE | REJECTION |
| EXAMPLE20 | 681 | 832 | 0.77 | ACCEPTANCE | 63 | ACCEPTANCE | 0.47 | ACCEPTANCE | 42 | ACCEPTANCE | NON-EXISTENCE | ACCEPTANCE |
| COMPARATIVE EXAMPLE20 | 655 | 804 | 0.23 | REJECTION | 119 | REJECTION | 0.08 | REJECTION | 250 | REJECTION | EXISTENCE | REJECTION |
| EXAMPLE21 | 606 | 827 | 0.56 | ACCEPTANCE | 45 | ACCEPTANCE | 0.33 | ACCEPTANCE | 51 | ACCEPTANCE | NON-EXISTENCE | ACCEPTANCE |
| COMPARATIVE EXAMPLE21 | 611 | 833 | 0.22 | REJECTION | 217 | REJECTION | 0.31 | ACCEPTANCE | 77 | ACCEPTANCE | NON-EXISTENCE | ACCEPTANCE |
| EXAMPLE22 | 754 | 829 | 0.70 | ACCEPTANCE | 12 | ACCEPTANCE | 0.45 | ACCEPTANCE | 7 | ACCEPTANCE | NON-EXISTENCE | ACCEPTANCE |
| COMPARATIVE EXAMPLE22 | 756 | 830 | 0.19 | REJECTION | 27 | REJECTION | 0.31 | ACCEPTANCE | 12 | ACCEPTANCE | NON-EXISTENCE | ACCEPTANCE |
| EXAMPLE23 | 719 | 810 | 0.86 | ACCEPTANCE | 20 | ACCEPTANCE | 0.74 | ACCEPTANCE | 18 | ACCEPTANCE | NON-EXISTENCE | ACCEPTANCE |

TABLE 4-continued

| | YIELD STRESS | TENSILE STRENGTH | CTOD VALUES OF A PARENT MATERIAL | | DUPLEX ESSO OF A PARENT MATERIAL | | CTOD VALUES OF A WELDED JOINT | | DUPLEX ESSO OF A WELDED JOINT | | UNSTABLE DUCTILE FRACTURE-SUPPRESSING CHARACTERISTIC | |
|---|---|---|---|---|---|---|---|---|---|---|---|---|
| | MPa | MPa | mm | EVALUATION | J | EVALUATION | mm | EVALUATION | mm | EVALUATION | mm | EVALUATION |
| COMPARATIVE EXAMPLE23 | 723 | 813 | 0.28 | REJECTION | 50 | REJECTION | 0.15 | REJECTION | 255 | REJECTION | EXISTENCE | REJECTION |
| EXAMPLE24 | 652 | 763 | 0.42 | ACCEPTANCE | 19 | ACCEPTANCE | 0.36 | ACCEPTANCE | 27 | ACCEPTANCE | NON-EXISTENCE | ACCEPTANCE |
| COMPARATIVE EXAMPLE24 | 651 | 762 | 0.25 | REJECTION | 71 | REJECTION | 0.37 | ACCEPTANCE | 37 | ACCEPTANCE | EXISTENCE | REJECTION |
| EXAMPLE25 | 658 | 769 | 0.66 | ACCEPTANCE | 9 | ACCEPTANCE | 0.45 | ACCEPTANCE | 12 | ACCEPTANCE | NON-EXISTENCE | ACCEPTANCE |
| COMPARATIVE EXAMPLE25 | 659 | 770 | 0.54 | ACCEPTANCE | 3 | ACCEPTANCE | 0.08 | REJECTION | 326 | REJECTION | EXISTENCE | REJECTION |
| EXAMPLE26 | 683 | 834 | 0.40 | ACCEPTANCE | 55 | ACCEPTANCE | 0.45 | ACCEPTANCE | 9 | ACCEPTANCE | NON-EXISTENCE | ACCEPTANCE |
| COMPARATIVE EXAMPLE26 | 689 | 841 | 0.28 | REJECTION | 134 | REJECTION | 0.11 | REJECTION | 181 | REJECTION | EXISTENCE | REJECTION |

The yield stress and the tensile strength were measured using the method of tensile test for metallic materials described in JIS Z 2241. The test specimen is the test piece for tensile test for metallic materials described in JIS Z 2201. Here, No. 5 test specimens were used for steel plates having a plate thickness of 20 mm or less, and No. 10 test specimens taken from the ¼ t portion were used for steel plates having a plate thickness of 40 mm or more. Meanwhile, the test specimens were taken in a manner in which the longitudinal direction of the test specimen became perpendicular to the rolling direction. The yield stress is the 0.2% proof stress computed using the offset method. The test was carried out on two test specimens at room temperature, and average values were taken for the yield stress and the tensile strength respectively.

The toughness of the base metal and the welded joint was evaluated using the CTOD tests based on BS7448. B×2B-type test specimens were used, and a 3-point bending test was carried out. For the base metal, evaluations were carried out in a C direction (plate thickness direction) in which the longitudinal direction of the test specimen became perpendicular to the rolling direction. For the welded joint, evaluations were carried out only in an L direction (rolling direction). For the evaluation of the CTOD value of the welded joint, test specimens were taken so that the front end of fatigue cracking corresponded to welded bond. The test was carried out on 3 test specimens at a test temperature of −165° C., and the minimum value of the obtained measurement data was taken as the CTOD value. For the CTOD test results (CTOD values), 0.3 mm or more was evaluated to be a "acceptance," and less than 0.3 mm was evaluated to be a "rejection."

Figure 5:
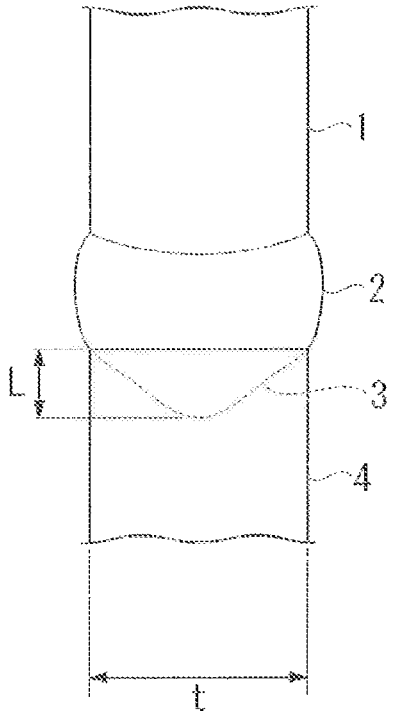
FIG. 5 is a partial schematic view of an example of a cracked surface of a test portion after a duplex ESSO test.

The arrestability of the base metal and the welded joint was evaluated using the duplex ESSO test. The duplex ESSO test was carried out based on the method described in FIG. 3 in Pressure Technologies, Vol. 29, Issue 6, p. 341. Meanwhile, the load stress was set to 392 MPa, and the test temperature was set to −165° C. In the duplex ESSO test, a case in which the cracking entry distance was twice or less the plate thickness was evaluated to be a "acceptance," and a case in which the cracking entry distance was more than twice the plate thickness was evaluated to be a "rejection." FIG. 5 shows a partial schematic view of an example of a cracked surface of a test portion after the duplex ESSO test. The cracked surface refers to an area including all of an embrittlement plate (entrance plate) 1, an attached welded portion 2, and a cracking entry portion 3 in FIG. 5, and the cracking entry distance L refers to the maximum length of the cracking entry portion 3 (cracked portion entering into the test portion (the base metal or a welded metal portion 4)) in a direction perpendicular to the direction of the plate thickness t. Meanwhile, for simple description, FIG. 5 shows only part of the embrittlement plate 1 and the test portion 4.

Here, the duplex ESSO test refers to a testing method schematically shown in, for example, the duplex ESSO test of FIG. 6 in H. Miyakoshi, N. Ishikura, T. Suzuki and K. Tanaka: Proceedings for Transmission Conf., Atlanta, 1981, American Gas Association, T155-T166.

Meanwhile, the welded joint used in the CTOD test and the duplex ESSO test was manufactured using SMAW. The SMAW was vertical position welding under conditions of a heat input of 3.5 kJ/cm to 4.0 kJ/cm and a temperature between preheating and pass of 100° C. or lower.

The unstable ductile fracture-suppressing characteristic of the welded joint was evaluated from the test results of the duplex ESSO test of the welded joint (changes in the fractured surface). That is, in a case in which propagation of brittle cracking stopped, and then cracking again proceeded due to unstable ductile fracture, the proceeding distance of the cracking due to the unstable ductile fracture (unstable ductile fracture occurrence distance) was recorded.

In Examples 1 to 26, since the chemical components, the Ni segregation ratios, and the fractions of austenite after deep cooling were appropriate, the fracture-resisting performance of the base metal and the welded joint were all "acceptances."

In Comparative examples 1 to 12, 18, and 20, since the chemical components were not appropriate, the fracture-resisting performance of the base metal and the welded joint were all "rejections."

In Comparative examples 13 to 16, 25, and 26, since the Ni segregation ratio was not appropriate, the fracture-resisting performance of the base metal and the welded joint were all "rejections." In the comparative examples, the conditions for the first thermal processing treatment were not appropriate.

In Comparative examples 17, and 21 to 23, since the fraction of austenite after deep cooling was not appropriate, the fracture-resisting performance of either the base metal or the welded joint were "rejections." In Comparative examples 17, 21, and 22, the conditions for the second thermal processing treatment were not appropriate. In addition, in Comparative examples 22 and 23, the conditions for the third thermal processing treatment were not appropriate.

In Comparative example 24, since the average equivalent circle diameter of austenite after deep cooling was not appropriate, the fracture-resisting performance of either the base metal or the welded joint were "rejections." In Comparative example 24, the conditions for the fourth thermal processing treatment were not appropriate.

In Comparative example 19, since the average equivalent circle diameter of austenite after deep cooling was not appropriate, the fracture-resisting performance of either the base metal or the welded joint were all "rejections." In Comparative example 19, the conditions for the second thermal processing treatment were not appropriate.

Meanwhile, in Example 6 and Comparative example 6, the controlled cooling in the second thermal processing treatment and the cooling in the third thermal processing treatment and the fourth thermal processing treatment was air cooling. Similarly, in Example 17 and Comparative example 17, the controlled cooling in the second thermal processing treatment was air cooling.

Thus far, preferable examples of the invention have been described, but the invention is not limited to the examples. Within the scope of the purports of the invention, addition, removal, substitution, and other changes of the configuration is possible. The invention is not limited by the above description, and is limited only by the attached claims.

INDUSTRIAL APPLICABILITY

It is possible to provide a steel plate that is excellent in fracture-resisting performance at approximately −160° C. with a content of Ni of approximately 6% and a method of manufacturing the same.

The invention claimed is:

1. A Ni-added steel plate comprising, by mass %:

C: 0.03% to 0.10%;
Si: 0.02% to 0.40%;
Mn: 0.3% to 1.2%;
Ni: 5.0% to 7.5%;
Cr: 0.4% to 1.5%;
Mo: 0.02% to 0.4%;
Al: 0.01% to 0.08%;
T.O: 0.0001% to 0.0050%;
P: limited to 0.0100% or less;
S: limited to 0.0035% or less;

N: limited to 0.0070% or less; and the balance consisting of iron and unavoidable impurities, wherein a Ni segregation ratio based on mass % at a position of ¼ of a plate thickness away from a plate surface in a thickness direction is 1.3 or less, a fraction of an austenite after a deep cooling is 2% or more, an austenite unevenness index after the deep cooling is 5.0 or less, and an average equivalent circle diameter of the austenite after the deep cooling is 1 μm or less, wherein the austenite unevenness index after the deep cooling is a value obtained by dividing a maximum area fraction by a minimum area fraction, in which, among data which are evaluated such that an evaluation of an area fraction of the austenite is carried out with each viewing areas thereof being defined as a 5×5 μm area and is continuously carried out in the thickness direction with being centered on the position of ¼ of the plate thickness away from the plate surface in the thickness direction, an average of the data of 5 largest area fractions of the austenite is defined to be the maximum area fraction and an average of the data of 5 smallest area fractions of the austenite is defined to be the minimum area fraction.

2. The Ni-added steel plate according to claim 1, further comprising, by mass %, at least one of:

Cu: 1.0% or less;

Nb: 0.05% or less;

Ti: 0.05% or less;

V: 0.05% or less;

B: 0.05% or less;

Ca: 0.0040% or less;

Mg: 0.0040% or less; and

REM: 0.0040% or less.

3. The Ni-added steel plate according to claim 2, wherein the Ni by mass % is 5.3% to 7.3%.

4. The Ni-added steel plate according to claim 2, wherein the plate thickness is 4.5 mm to 80 mm.

5. The Ni-added steel plate according to claim 1, wherein the Ni by mass % is 5.3% to 7.3%.

6. The Ni-added steel plate according to claim 1, wherein the plate thickness is 4.5 mm to 80 mm.

7. A method of manufacturing a Ni-added steel plate according to claim 1, comprising:

a first thermal processing treatment in which a slab containing, by mass %,

C: 0.03% to 0.10%;

Si: 0.02% to 0.40%;

Mn: 0.3% to 1.2%;

Ni: 5.0% to 7.5%;

Cr: 0.4% to 1.5%;

Mo: 0.02% to 0.4%;

Al: 0.01% to 0.08%;

T.O: 0.0001% to 0.0050%;

P: limited to 0.0100% or less;

S: limited to 0.0035% or less;

N: limited to 0.0070% or less; and the balance consisting of iron and unavoidable impurities is held at a heating temperature of 1250° C. to 1380° C. for 8 hours to 50 hours, and thereafter an air-cooling to 300° C. or lower is performed;

a second thermal processing treatment in which the slab is heated to 900° C. to 1270° C., a hot rolling is performed by a rolling reduction of 2.0 to 40 with controlling a temperature before a final pass to 660° C. to 900° C., and immediately, a cooling is performed;

a third thermal processing treatment in which the slab is heated to 600° C. to 750° C., and thereafter, a cooling is performed; and a fourth thermal processing treatment in which the slab is heated to 500° C. to 650° C., and thereafter, a cooling is performed.

8. The method of manufacturing the Ni-added steel plate according to claim 7, wherein the slab further contains, by mass %, at least one of Cu: 1.0% or less;

Nb: 0.05% or less;

Ti: 0.05% or less;

V: 0.05% or less;

B: 0.05% or less;

Ca: 0.0040% or less;

Mg: 0.0040% or less; and

REM: 0.0040% or less.

9. The method of manufacturing the Ni-added steel plate according to claim 8, wherein, in the first thermal processing treatment, before the air cooling, a hot rolling is performed by a rolling reduction of 1.2 to 40 with controlling a temperature before a final pass to 800° C. to 1200° C.

10. The method of manufacturing the Ni-added steel plate according to claim 8, wherein, in the second thermal processing treatment, after the hot rolling and the cooling, a reheating to 780° C. to 900° C. is performed.

11. The method of manufacturing the Ni-added steel plate according to claim 8, wherein, in the first thermal processing treatment, before the air cooling, a hot rolling is performed by a rolling reduction of 1.2 to 40 with controlling a temperature before a final pass to 800° C. to 1200° C., and, in the second thermal processing treatment, after the hot rolling and the cooling, a reheating to 780° C. to 900° C. is performed.

12. The method of manufacturing the Ni-added steel plate according to claim 7, wherein, in the first thermal processing treatment, before the air cooling, a hot rolling is performed by a rolling reduction of 1.2 to 40 with controlling a temperature before a final pass to 800° C. to 1200° C.

13. The method of manufacturing the Ni-added steel plate according to claim 7, wherein, in the second thermal processing treatment, after the hot rolling and the cooling, a reheating to 780° C. to 900° C. is performed.

14. The method of manufacturing the Ni-added steel plate according to claim 7, wherein, in the first thermal processing treatment, before the air cooling, a hot rolling is performed by a rolling reduction of 1.2 to 40 with controlling a temperature before a final pass to 800° C. to 1200° C., and, in the second thermal processing treatment, after the hot rolling and the cooling, a reheating to 780° C. to 900° C. is performed.

* * * * *